US011667358B2

(12) United States Patent
Boyer et al.

(10) Patent No.: US 11,667,358 B2
(45) Date of Patent: Jun. 6, 2023

(54) WATERCRAFT

(71) Applicant: Pelican International Inc., Laval (CA)

(72) Inventors: Réjean Boyer, Laval (CA); Isabelle Dubreuil, Laval (CA); Jean-Thomas Girard, Bois-des-Filion (CA)

(73) Assignee: PELICAN INTERNATIONAL INC., Laval (CA)

( * ) Notice: Subject to any disclaimer, the term of this patent is extended or adjusted under 35 U.S.C. 154(b) by 0 days.

(21) Appl. No.: 16/888,508

(22) Filed: May 29, 2020

(65) Prior Publication Data

US 2021/0371057 A1 Dec. 2, 2021

(51) Int. Cl.

| | |
|---|---|
| ***B63B 34/23*** | (2020.01) |
| ***B63B 34/26*** | (2020.01) |
| ***B63B 34/10*** | (2020.01) |
| ***B63B 34/00*** | (2020.01) |

(52) U.S. Cl.

CPC ..... *B63B 34/23* (2020.02); *B63B 34/05* (2020.02); *B63B 34/10* (2020.02); *B63B 34/26* (2020.02)

(58) Field of Classification Search

CPC ..... B63B 34/23; B63B 34/05; B63B 34/26; B63B 34/10

See application file for complete search history.

(56) References Cited

U.S. PATENT DOCUMENTS 5,082,328 A * 1/1992 Garelick ..... B63B 29/04 297/344.21
5,992,935 A * 11/1999 Duijnstee ..... B66B 9/08 297/344.21
6,065,422 A * 5/2000 Davidson ..... B63B 29/04 248/503.1
6,499,712 B1 * 12/2002 Clark ..... B63B 29/04 248/424
7,150,442 B2 * 12/2006 Kleckner ..... A01K 97/01 135/137
8,678,337 B2 * 3/2014 Grunewald ..... B60N 2/01575 248/424
9,248,897 B2 * 2/2016 Shields ..... B63H 20/06
10,059,227 B2 * 8/2018 Kostin ..... B60N 2/0232
2001/0025595 A1 * 10/2001 Mielke ..... B63B 5/06 114/343
2002/0129756 A1 * 9/2002 Myers ..... B63B 34/10 114/354
2003/0052246 A1 * 3/2003 Hoshihara ..... B60N 2/067 248/430
2007/0289522 A1 * 12/2007 Rose'Meyer ..... B63H 25/02 114/144 R (Continued)

*Primary Examiner* — S. Joseph Morano
*Assistant Examiner* — Jovon E Hayes
(74) *Attorney, Agent, or Firm* — Morgan, Lewis & Bockius LLP

(57) ABSTRACT

The invention relates to a watercraft, particularly a kayak having a battery compartment and motor mount for mounting a motor thereto. The kayak can be propelled either by a motor mounted to the motor mount or by manual paddling by a user of the kayak. The kayak may additionally have a seat mounted onto a track to allow the user to adjust their position as needed in the kayak. The kayak is extra wide to provide stability, while chamfered side walls allow the user to paddle with comfort regardless of the extra width. The kayak may optionally have wheels mounted thereon to facilitate handling and transport by the user.

29 Claims, 25 Drawing Sheets

(56) References Cited

U.S. PATENT DOCUMENTS

| | | | | |
|---|---|---|---|---|
| 2010/0045078 | A1* | 2/2010 | Lee | A47C 7/407 297/188.1 |
| 2010/0264288 | A1* | 10/2010 | Thuleau | B60N 2/0705 248/429 |
| 2011/0031772 | A1* | 2/2011 | Mabuchi | B60N 2/01 296/64 |
| 2011/0278419 | A1* | 11/2011 | Sovis | B60N 2/0705 474/148 |
| 2013/0015313 | A1* | 1/2013 | Schmid | B60N 2/067 248/429 |
| 2013/0074760 | A1* | 3/2013 | VanNimwegen | B63B 34/20 114/362 |
| 2014/0374563 | A1* | 12/2014 | Tuji | B60N 2/067 248/429 |
| 2016/0340002 | A1* | 11/2016 | Gonzales, III | B63B 34/26 |
| 2018/0215287 | A1* | 8/2018 | Koop | B60N 2/0232 |
| 2020/0101868 | A1* | 4/2020 | Kim | B60N 2/10 |
| 2020/0156553 | A1* | 5/2020 | Kang | B60N 2/14 |

* cited by examiner

WATERCRAFT

TECHNICAL FIELD

The invention relates to a watercraft. More specifically, the present invention relates to an extra wide personal fishing watercraft having a sliding and swivel seat, a motor mount allowing mounting of an off-the-shelf motor thereto and a battery compartment housing a battery for feeding electric power to an electric motor, and configured to maximise the user space to fish in a seating or stand-up position in multiple directions.

BACKGROUND OF THE ART

Kayaks, along with canoes and other personal water faring devices, are commonly used for recreational travel across bodies of water including lakes and rivers. These lightweight devices provide a more cost-effective alternative to motorized boats. Additionally, they are simpler to operate legally (e.g. may not require a license), simpler to transport (i.e. without the use of a separate trailer to pull the water faring device) and can operate in shallower waters than larger boats.

Although kayaks have many advantages compared to boats, they are generally provided as paddling devices. It would be preferable to allow a user to safely use a motor in conjunction with the kayak and without jeopardizing the kayak's paddling capability, for example through the motor being too heavy or too cumbersome to install and remove. Additionally, while some water faring devices are configured to receive motors, these motors tend to be specifically made for the device. That is to say that off-the-shelf motors cannot be used, resulting in increased cost. Furthermore, these devices tend to be designed with the motor mounted in the middle section of the water faring device, constricting the space available for the user to move or to accommodate their legs.

Another drawback of kayaks is that although they may be transported to near water, they must generally be carried from a truck (or any other transportation device) to the water itself. Given that a kayak is a personal device and usually carried by a single individual, transporting a kayak to water can be cumbersome, particularly given that in some locations the vehicle may need to be parked far from the body of water where the kayak will be deployed. Additionally, there is the potential for damage to the kayak body if improperly handled.

Another shortcoming of kayaks is that many tend to be inherently unstable. The result is that a user may be easily thrown overboard if the kayak is not operated exactly as designed, which generally requires the user to remain in a seating position and to avoid extended movements in sideward direction. This tends to limit the use of kayak for applications like fishing, since the efficient practice of this sport tends to require movements of the upper body in various directions (e.g. for casting), whether in seating or stand-up positions.

Therefore, it would be desirable to be provided with a fishing watercraft that alleviates at least some of the above-identified drawbacks.

SUMMARY

According to a broad aspect, there is provided a watercraft comprising a body extending along a longitudinal axis $L_1$, comprising a deck and a hull, the deck comprising a seating area, the seating area comprising at least one rail extending along the longitudinal axis $L_1$ and a swivel seat assembly removably mounted on the at least one rail, the swivel seat assembly being securably affixed to the at least one rail to allow sliding movement of the seat assembly along the at least one rail.

In one embodiment, the watercraft further comprises a motor mount mounted on the deck and outside the seating area, the motor mount being adapted for mounting a motor thereon.

In another embodiment, the motor mount comprises a base for mounting the motor mount to the deck of the kayak and a mounting portion extending generally vertically from the base.

In yet another embodiment, the mounting portion of the motor mount comprises a lip for preventing slipping of the motor against the motor mount.

In still another embodiment, the watercraft further comprises a battery compartment.

In still another embodiment, the motor mount and battery compartment are electrically connectable through wiring provided inside the body of the watercraft.

In still another embodiment, the battery compartment has a securably removable battery cover to prevent ingress of liquid into the battery compartment.

In still another embodiment, the battery compartment is mounted at a first end of the watercraft and the motor mount is mounted at a second end of the watercraft, opposite the first end.

In still another embodiment, the first end of the watercraft is the bow end and the second end of the watercraft is the stern end.

In still another embodiment, the watercraft is a fishing watercraft.

In still another embodiment, the fishing watercraft is a fishing kayak.

In still another embodiment, the watercraft comprises at least one wheel mounted to the body.

In still another embodiment, the watercraft comprises a recessed slot in the hull adapted to mounting a transducer therein.

According to another aspect, there is provided a watercraft comprising a body extending along a longitudinal axis $L_1$, comprising a deck and a hull, the deck comprising a recessed area and including two side walls, wherein the recessed area includes a seating area, the seating area comprising at least one rail extending along the longitudinal axis $L_1$ and a swivel seat assembly removably mounted on the at least one rail, the swivel seat assembly being securably affixed to the at least one rail to allow sliding movement of the seat assembly along the at least one rail.

In one embodiment, the watercraft has at least one side wall handle mounted to at least one of the two side walls, the at least one side wall handle having tracks therein.

In another embodiment, the watercraft has at least one handle mounted to a front end of the watercraft.

In yet another embodiment, the watercraft additionally includes a motor mount mounted on a stern end of the watercraft and outside the recessed area for mounting a motor thereon.

In still another embodiment, the motor mount comprises a base for mounting the motor mount to the deck of the watercraft and a mounting portion extending generally vertically from the base.

In still another embodiment, the motor mount has a lip for preventing slipping of the motor against the motor mount.

In still another embodiment, the watercraft includes a battery compartment.

In still another embodiment, the motor mount and battery compartment are electrically connectable through wiring provided inside the body of the watercraft.

In still another embodiment, the battery compartment is mounted at a bow end of the watercraft and the motor mount is mounted at a stern end of the watercraft./8

BRIEF DESCRIPTION OF THE DRAWINGS

Having thus generally described the nature of the invention, reference will now be made to the accompanying drawings, showing by way of illustration example embodiments thereof and in which.

DETAILED DESCRIPTION

FIGS. 1 to 9 show an example of a watercraft in accordance with an embodiment of the invention. In this embodiment, the watercraft is a fishing kayak 10 comprising a body 12 having a bow (front) end 14 and a stern (rear) end 16 opposite the bow end 14. The body 12 extends along a longitudinal axis $L_1$-$L_1$ from the bow end 14 to the stern end 16. The kayak 10 has a length L defined by the longitudinal axis $L_1$-$L_1$, a width W transversal to the longitudinal axis $L_1$-$L_1$, and a height H transversal to the widthwise and longitudinal directions. As the kayak 10 is primarily designed for fishing, the body 12 of the kayak 10 may be made relatively wide to assist in providing increased stability to the watercraft.

Figure 7:
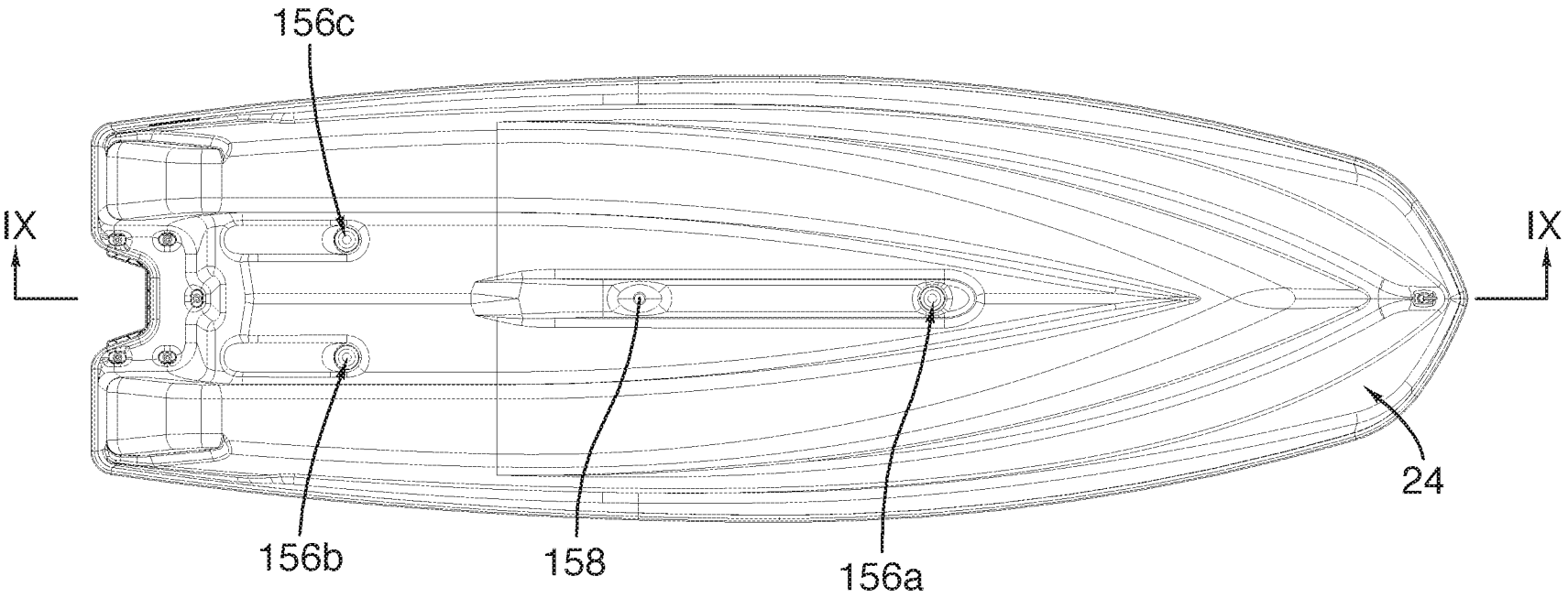
FIG. 7 is a bottom plan view of the watercraft shown in FIG. 1.
Figure 8:
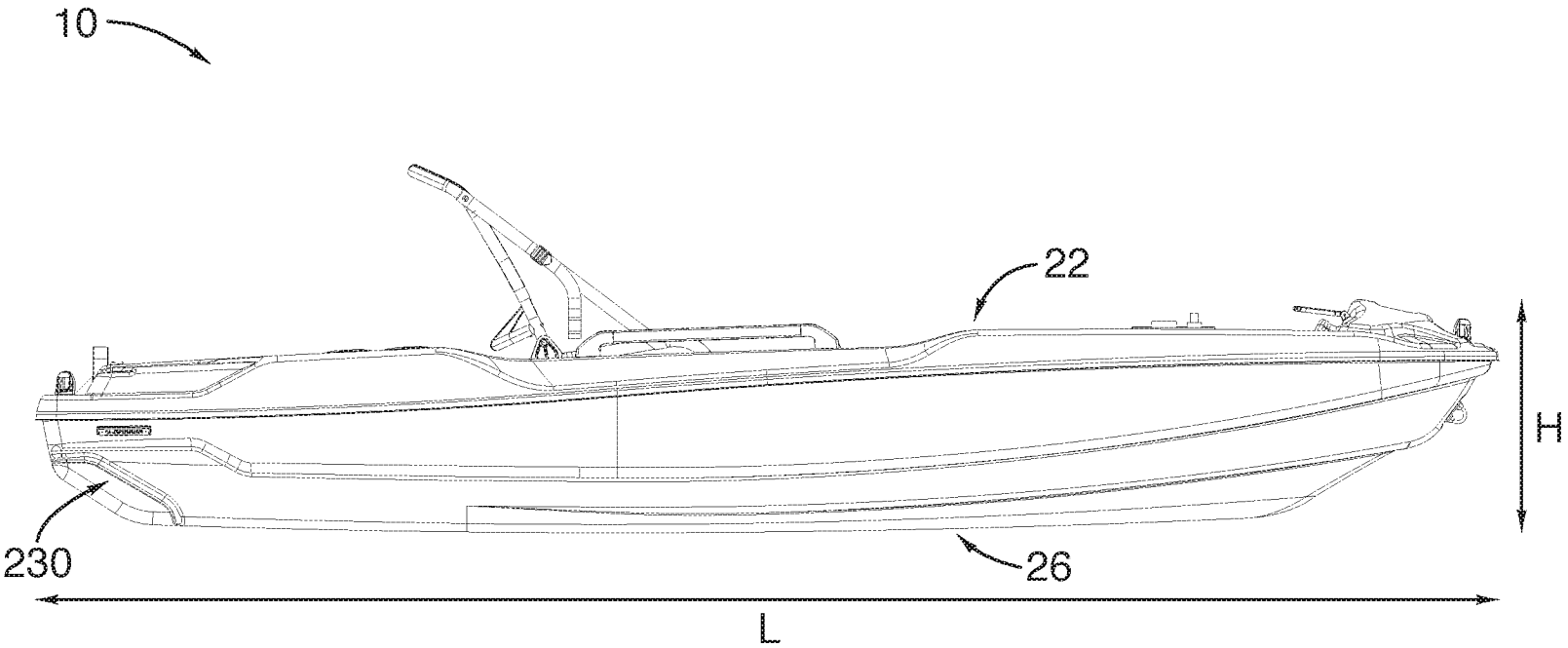
FIG. 8 is a side elevation view of the watercraft shown in FIG. 1.

The body 12 of the kayak 10 comprises a deck 20 defining a top side 22 of the body 12 and a hull 24 defining a bottom side 26 of the body 12 (best shown in FIGS. 7 & 8). The deck 20 is configured for accommodating a user of the kayak 10 while the hull 24 is configured to engage water onto which the kayak 10 floats and travels.

With additional reference to FIGS. 1 to 9, the deck 20 comprises a recessed area 30 having a front (bow) end 32 and a rear (stern) end 34, the recessed area 30 being surrounded by a front wall 31, a rear wall 39, a pair of spaced-apart side walls 33, 35 extending therebetween, and a bottom wall 37. The recessed area 30 defines a battery compartment 36 proximal to the bow end 32 and a seating area 38 extending between the battery compartment 36 and the rear end 34 of the recessed area 30.

Figure 1:
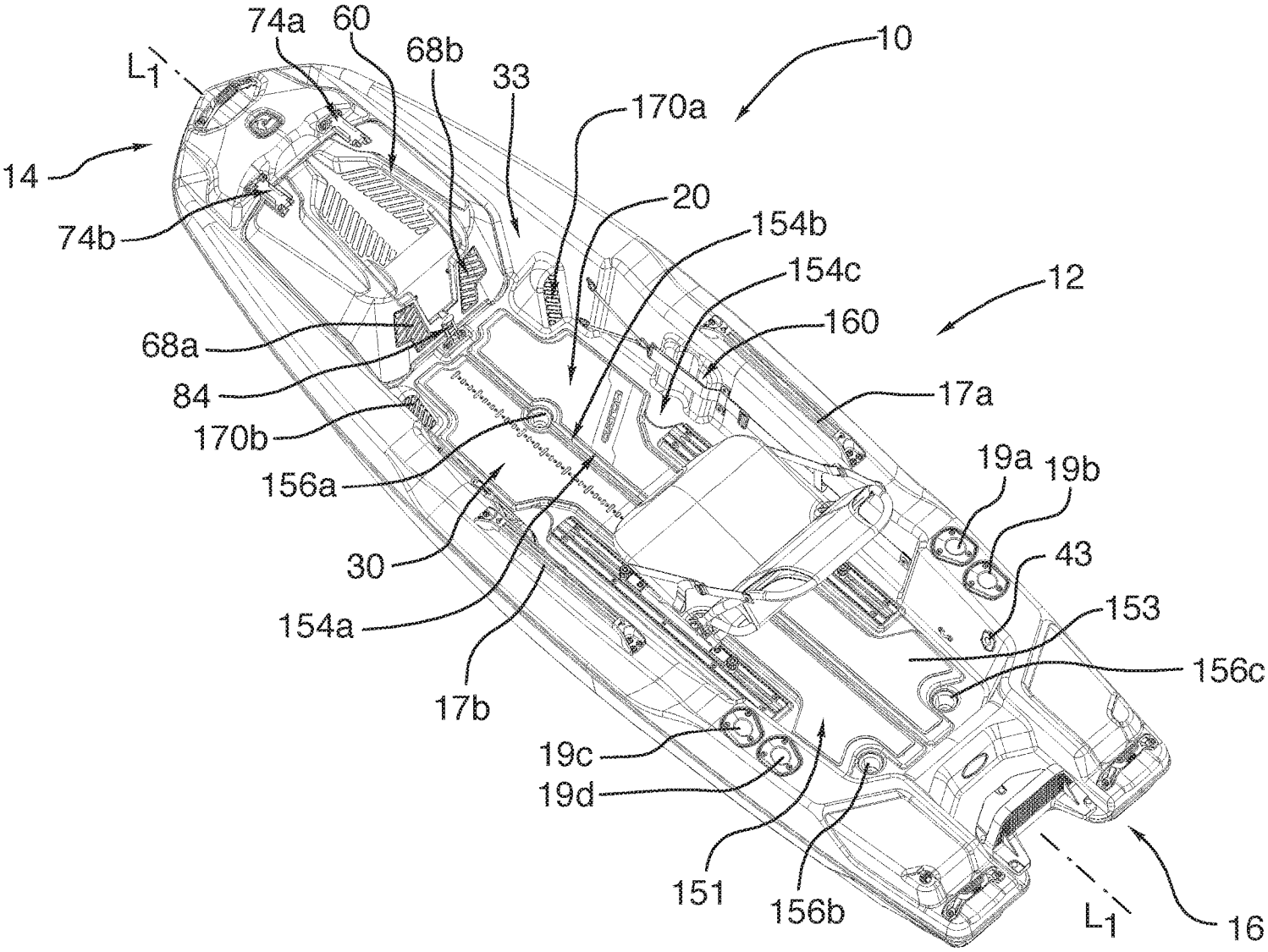
FIG. 1 is top perspective view of a watercraft in accordance with one embodiment.
Figure 6:
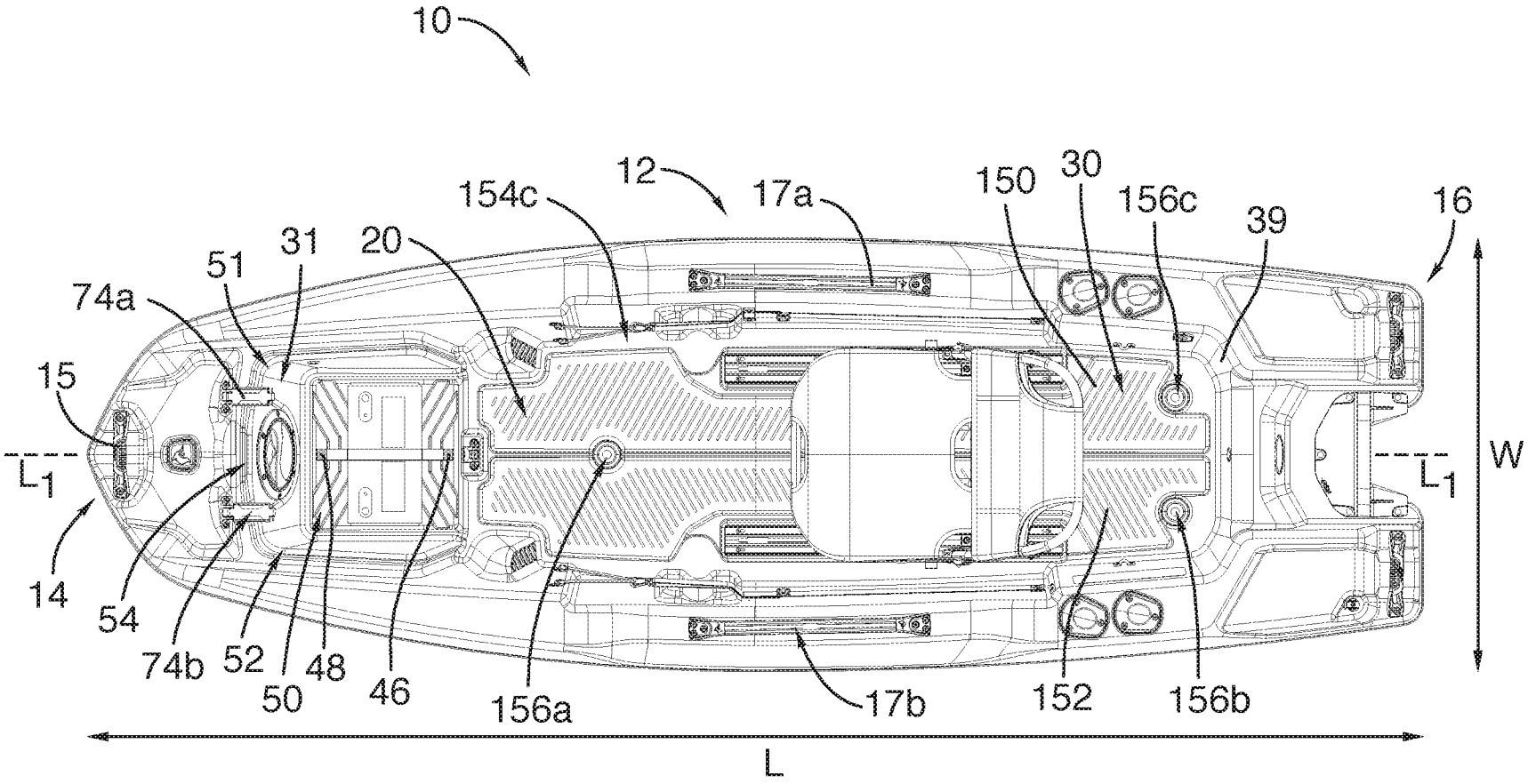
FIG. 6 is a top plan view of the watercraft shown in FIG. 2.
Figure 9:
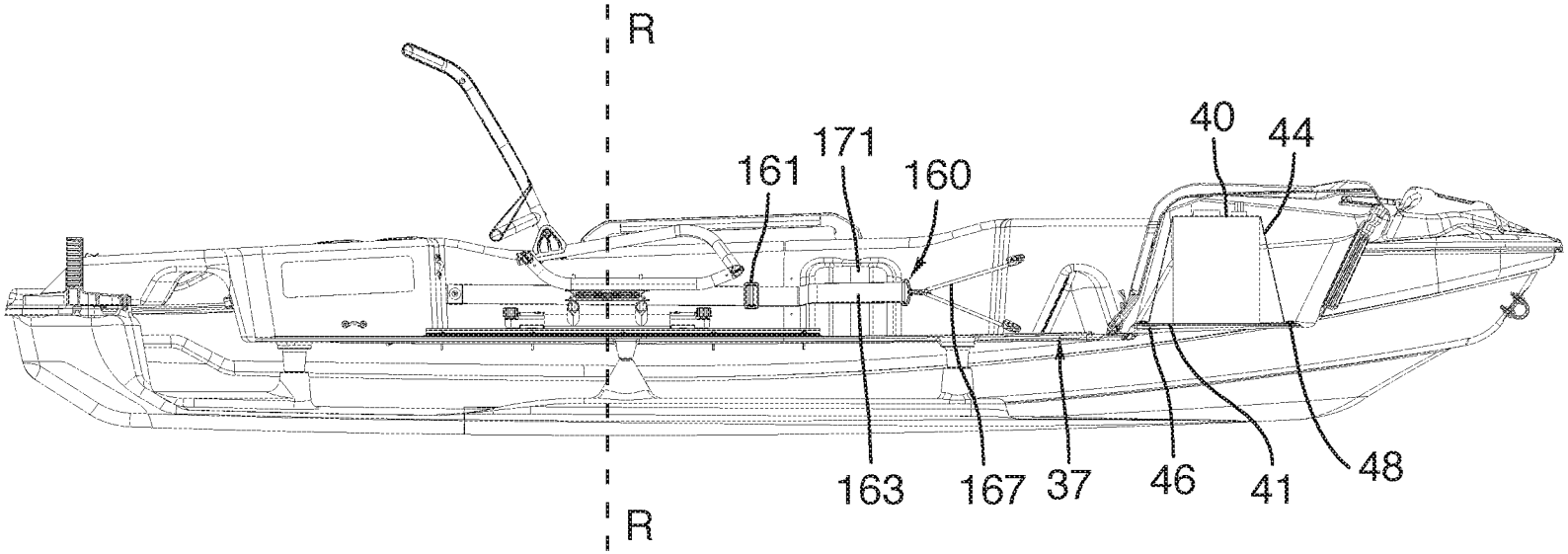
FIG. 9 is an elevation view of the cross section of the watercraft shown in FIG. 7, taken along the line IX-IX.

More specifically, the battery compartment 36 is defined by the front wall 31 and a portion of the spaced-apart side walls 33, 35 and is sized and shaped to receive a battery 40 such as a standard 12-volt marine battery, for supplying an electric motor (not shown) with electricity, as it will become apparent below. Defined in the side wall 33 of the battery compartment 36 is a first cable hole 42, while proximate to the rear wall 39 of the recessed area 30 is a second cable hole 43 defined in the side wall 33. The two cable holes 42, 43 are used for routing an electric cable (not shown) inside the body 12 of the kayak 10, between the battery compartment 36 and the motor mount 210, for electrically connecting the battery 40 to the electric motor (not shown). Provided in the battery compartment 36 is a battery tie down strap 44 engaging the top of the battery 40 and having a first end 46 secured to the bottom wall 41 of the battery compartment 36 proximal to the front wall 31 and a second end 46 secured to the battery compartment bottom wall 41 proximal to the junction between the battery compartment 36 and the seating area 38. In the illustrated embodiment, the first and second ends 46, 48 of the battery tie down strap are 44 secured to the bottom wall 41 of the battery compartment 36 using threaded fasteners, although it will be understood that they could be secured differently. As best shown in FIGS. 6 and 9, the bottom wall 41 of the battery compartment 36 is slightly raised as compared to the bottom wall 37 of the seating area 38, therefore providing an elongated abutment surface 50 extending between the spaced-apart side walls 33, 35. Further, the side walls 33, 35 and front wall 31 slightly project inside the battery compartment 36 to define a pair of generally L-shaped side-wall abutments 51, 52 and a front wall abutment 54 (best seen in FIG. 6). As it will become apparent below, the abutments 50, 51, 52, 54 collaborate with a battery cover 60 to enclose the battery compartment 36, which is best shown in FIG. 1 (showing the battery cover 60 installed) and FIG. 2 (showing the battery cover 60 removed to better show the battery compartment 36).

Defined in the front wall 31 of the battery compartment 36 is a circular hole (not shown) for providing access to a sealable storage compartment (not shown), the circular hole being closable using a waterproof cover or plug 72.

Figure 3:
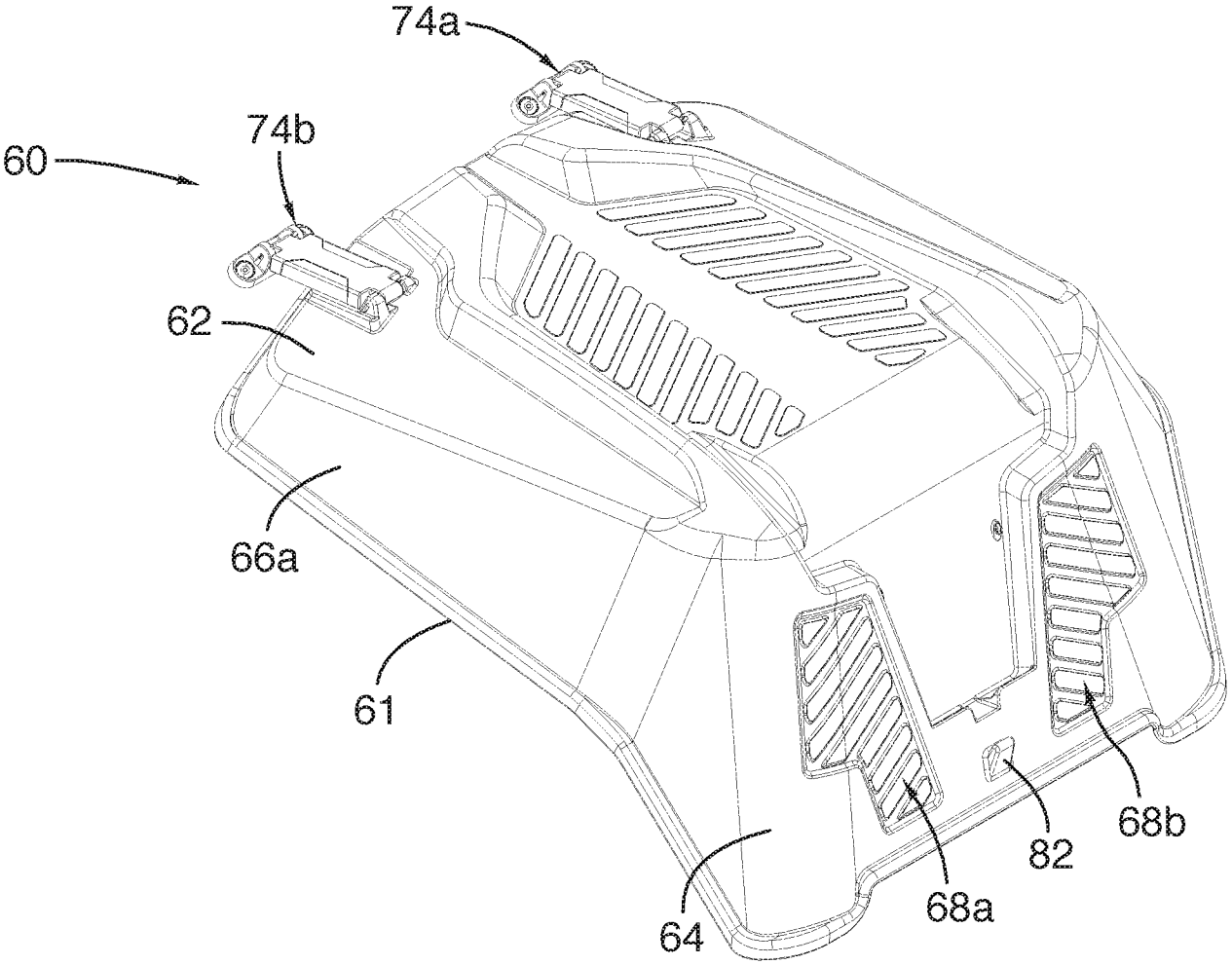
FIG. 3 is a top perspective view of the battery cover of the watercraft shown in FIG. 1.
Figure 4:
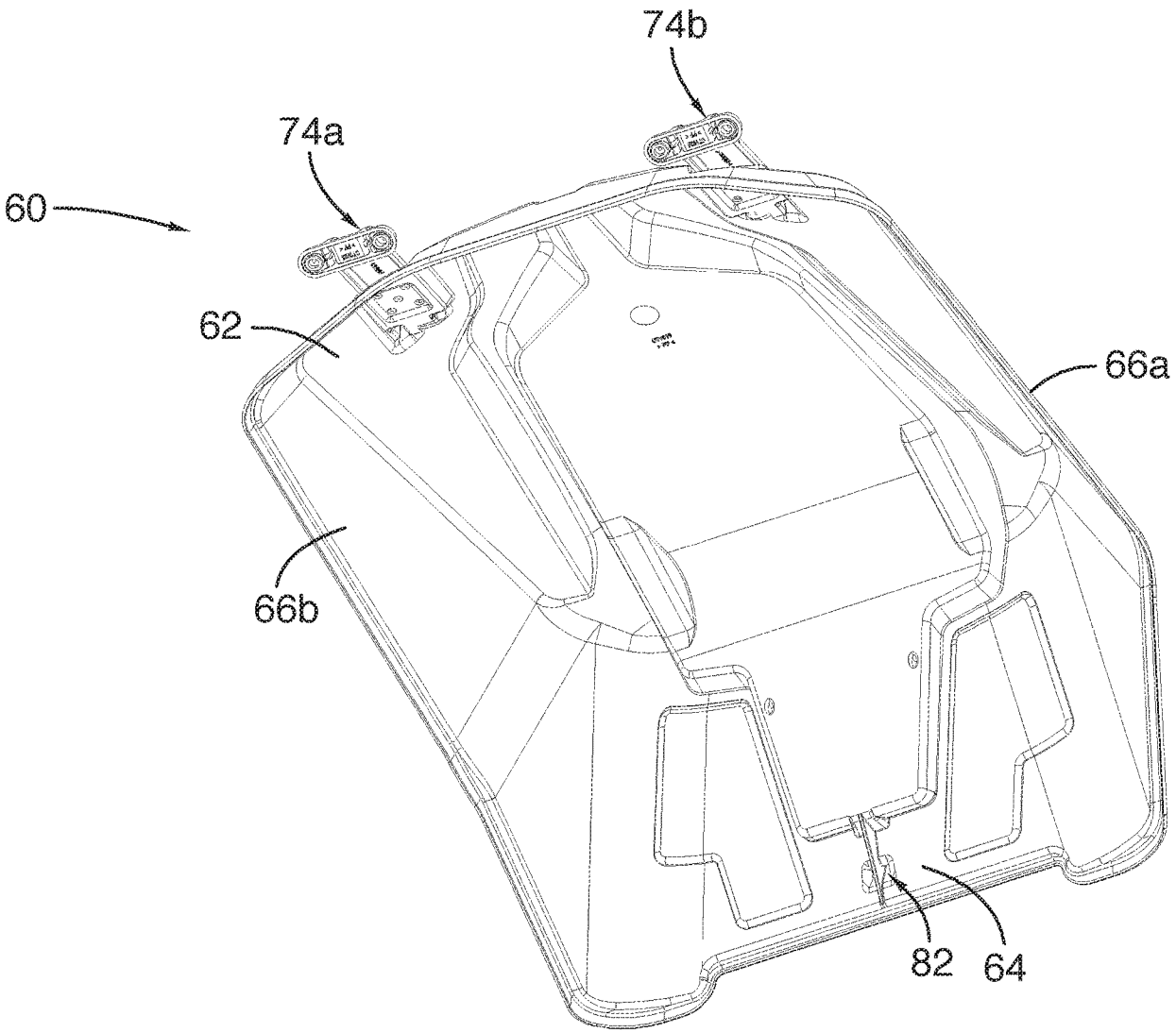
FIG. 4 is a bottom perspective view of the battery cover shown in FIG. 3.
Figure 5:
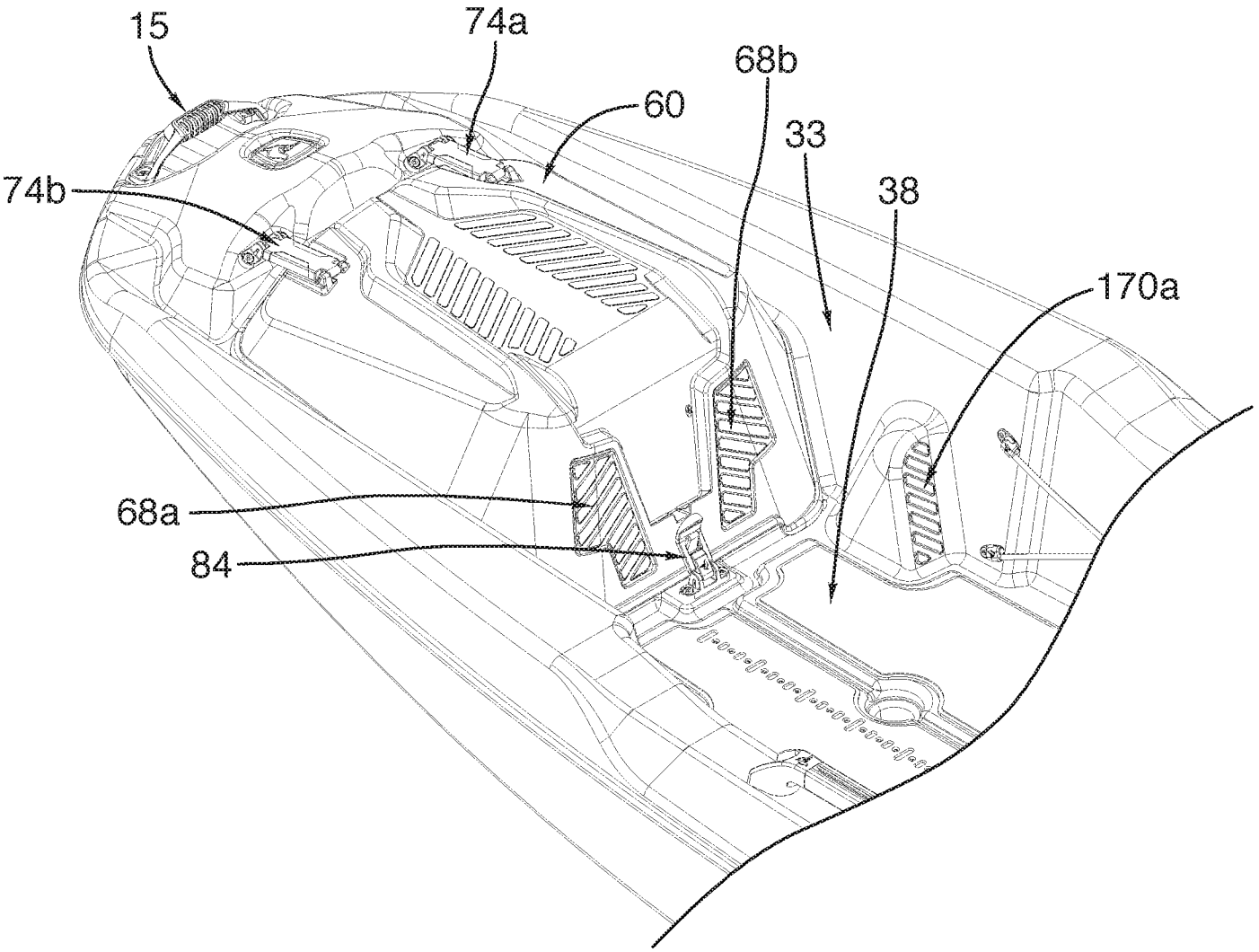
FIG. 5 is a top perspective view of the bow end of the watercraft, for better showing the battery cover and its surrounding parts.

Provided at the junction of the front wall 31 of the battery compartment 36 and the top side 22 of the deck 20, above the front wall abutment 54, are spaced-apart hinges 74*a*, 74*b* for pivotably mounting the battery cover 60 to the deck 20 in order to close the battery compartment 36. As best shown in FIGS. 3 and 4, the battery cover 60 comprises a top wall 62 defining a generally horizontal surface when the battery cover is closed (as shown in FIG. 1), an angled back wall 64 and a pair of side walls 66*a*, 66*b*, the back and side walls 64, 66*a*, 66*b* downwardly and angularly extending from the top wall 62. Together, the top, side and back walls 62, 66*a*, 66*b*, 64 of the battery cover 60 define a peripheral edge 61 matching a contour defined by the abutments 50, 51, 52, 54, the abutments 50, 51, 52, 54 providing support for the battery cover 60.

Although the illustrated embodiment shows two hinges 74*a* 74*b* at the bow end 14 of the kayak 10 pivotably attaching the battery cover 60 to the body 12, alternatively there may be one or more hinges, or they may pivotably attach the battery cover to a side wall 33, 35. Any other alternative may also be evident, such as a sliding battery cover 60 for covering the battery 40. Additionally, the battery compartment 36 and battery cover 60 may be different, for example by incorporating a battery compartment in the body 12 of the kayak 10 or under the deck 20 with a hatch providing access and cover to a battery. Other embodiments may be evident to the skilled addressee.

Defined on the back wall 64 of the battery cover 60 are a pair of spaced-apart footrests 68*a*, 68*b* for allowing a user to position their feet, as well as a hook 82 integrally formed in the back wall 64 and extending rearwardly, between the footrests 68*a*, 68*b*. The hook 82 of the battery cover 60 collaborates in a hook and eye configuration with an eye lock 84 pivotably mounted to the bottom wall 37 of the recessed area 30, proximal to the junction between the battery compartment 36 and the seating area 38, to maintain the battery cover 60 in a closed position. As it will be apparent, to access the battery compartment 36, for instance to replace or recharge the battery 40, the eye lock 84 is disengaged from the hook 82 of the battery cover 60, after which the battery cover 60 can be lifted upwardly and toward the front end of the kayak 10, thanks to the pivot axis defined by the two hinges 74*a*, 74*b*. To close the battery compartment 36, the battery cover 60 is pivoted rearwardly and downwardly until the top, side and back walls 62, 66*a*, 66*b*, 64 rest against the abutment surfaces 54, 51, 52, 50, at which point the eye lock 84 can be positioned to engage the hook 82 of the battery cover 60, to prevent unwanted movement thereof. As it will be appreciated, a means of sealing may be used to render the battery compartment 36 water resistant. For example, rubber seals or gaskets may be used to seal between the battery cover 60 and the abutment surfaces 50, 51, 52, 54 to prevent ingress of liquid when the battery cover 60 is closed.

Furthermore, in the embodiment depicted, the deck 20 comprises four rod holders 19*a*-19*d* for holding fishing rods or paddles (not shown).

Figure 2:
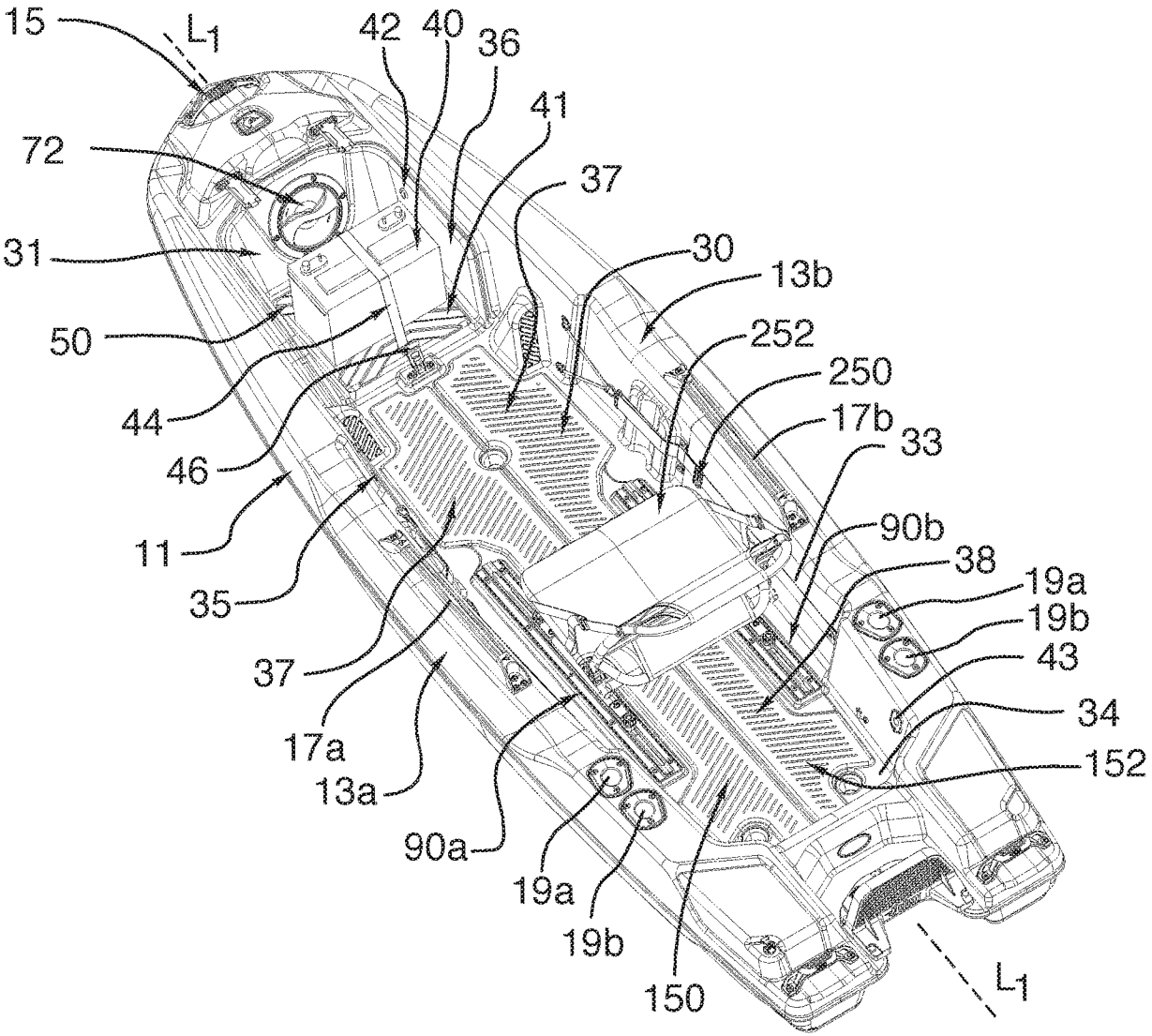
FIG. 2 is a top perspective view of the watercraft shown in FIG. 1, with the battery cover and anti-slip mats on the floor of the seating area removed.

Turning now to FIG. 2, the seating area 38 will now be described. Although it is called a "seating area", it will be understood that it is also configured for a user to stand up, as it will become apparent below. The seating area 38 comprises a pair of spaced-apart, raised mounting portions 90*a*, 90*b* and a pair of spaced-apart, parallel extending longitudinal rails 92*a*, 92*b* mounted to the mounting portions 90*a*, 90*b* for slidably mounting a swivel seat assembly 250. The rails 92*a*, 92*b* being identical to one another, only rail 92*a* will be described. It will be understood that the same description also applies to rail 92*b*.

Figure 10:
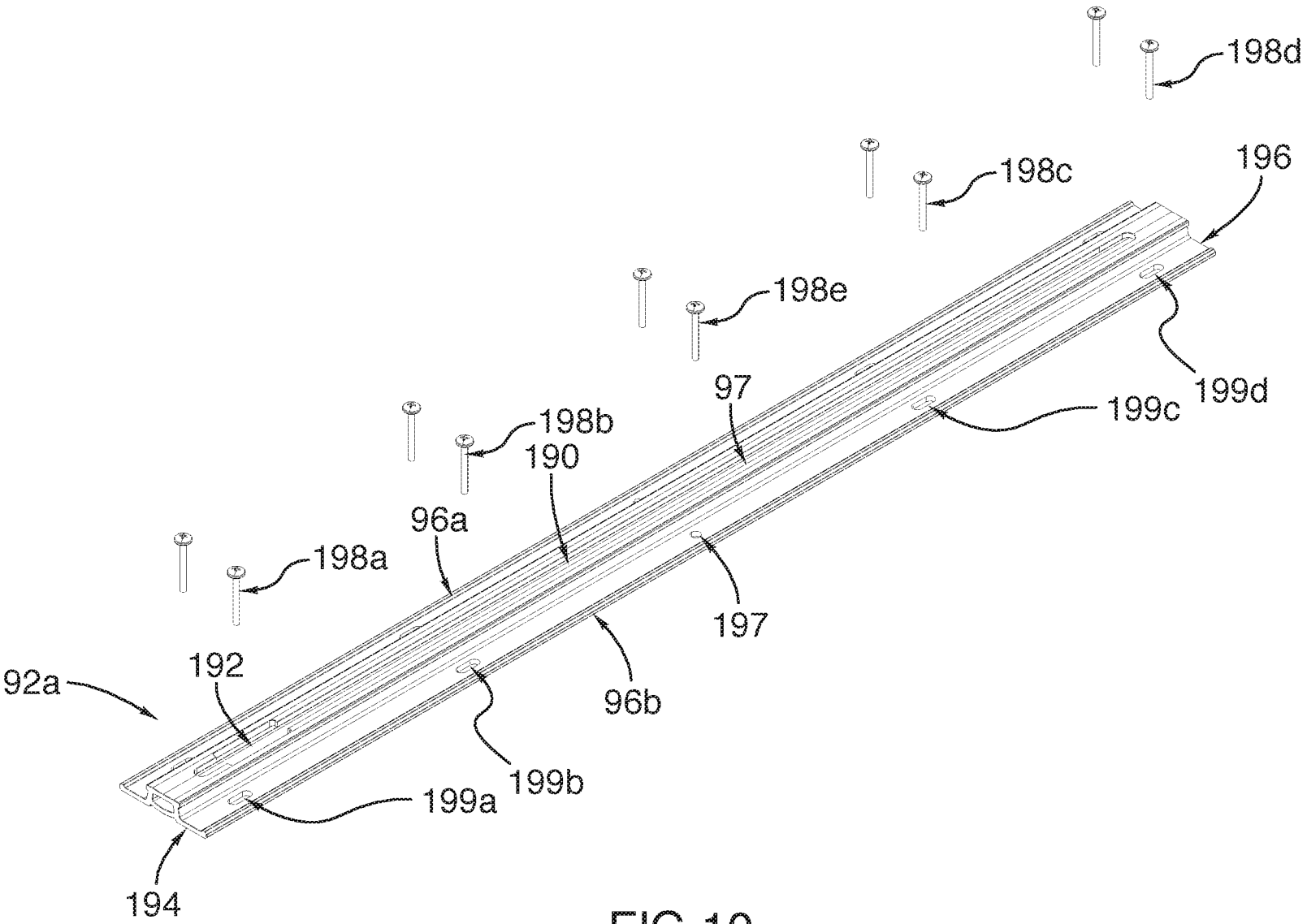
FIG. 10 is a top perspective view of a rail for mounting a seat assembly thereon, in accordance with one embodiment.

With reference to FIG. 10, rail 92*a* generally consists of a plastic extrusion comprising a central portion 94 and a pair of lateral flanges 96*a*, 96*b* extending on each side of the central portion 94, for mounting the rail 92*a* to the bottom wall 37 of the seating area 38, as it will be described in greater details below. Alternatively, the rail 92*a* may be made of a metal such as aluminium or any other suitable material.

Figure 11:
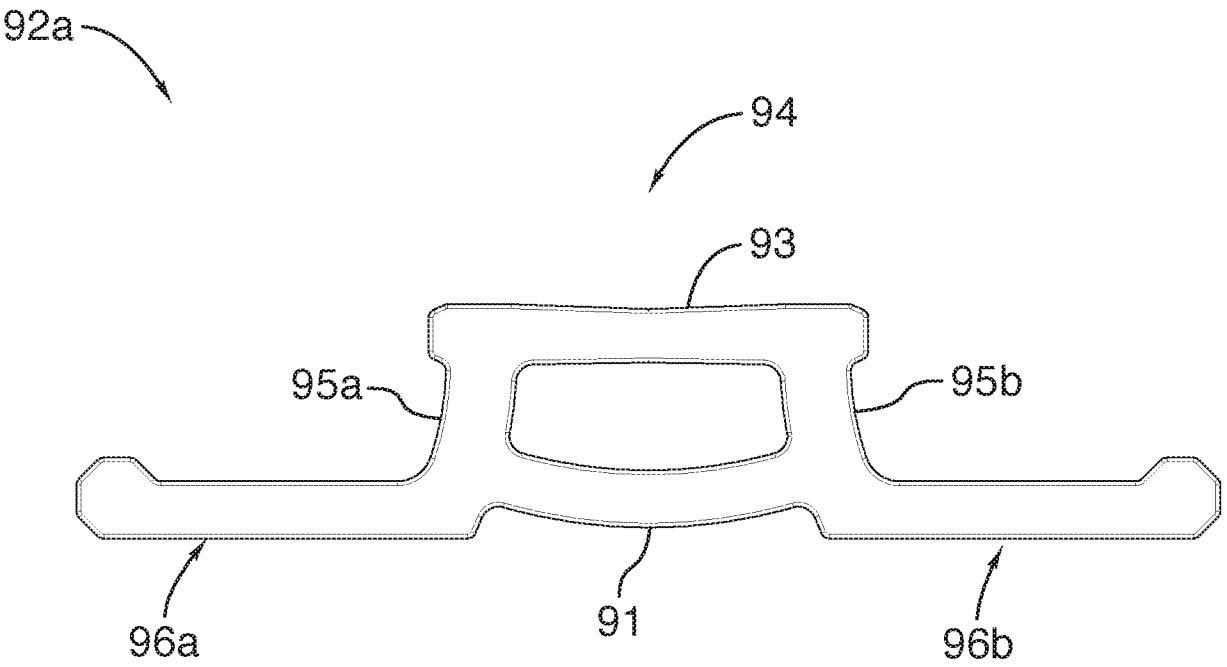
FIG. 11 is a front view of the rail shown in FIG. 10.

With reference to FIGS. 10 and 11, when seen from one end the central portion 94 of the rail 92*a* comprises a generally V-shaped bottom wall 91, a generally flat top wall 93, and a pair of side walls 95*a*, 95*b* extending from the top wall 93 and connecting the bottom wall 91 and the lateral flanges 96*a*, 96*b*. Defined on the top wall 93 of the central portion 94 is an elongated slot 190, extending proximal to front and rear ends 194, 196 of the rail 92*a* as well as a receiving opening 192 located proximal to the front end 194 of the rail 92*a*.

Figure 13:
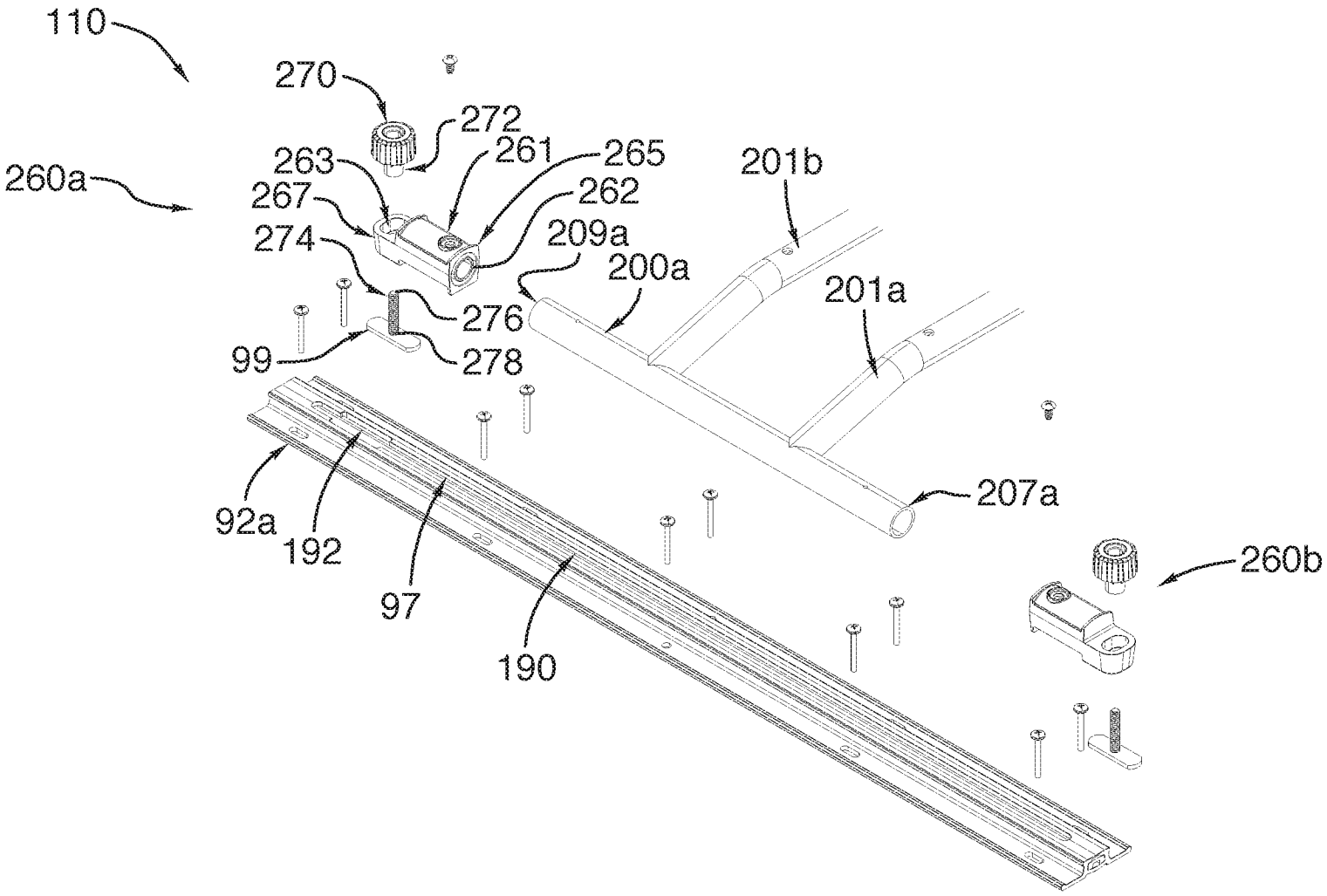
FIG. 13 is one half of a lower frame assembly of the seat shown in FIG. 12.
Figure 14:
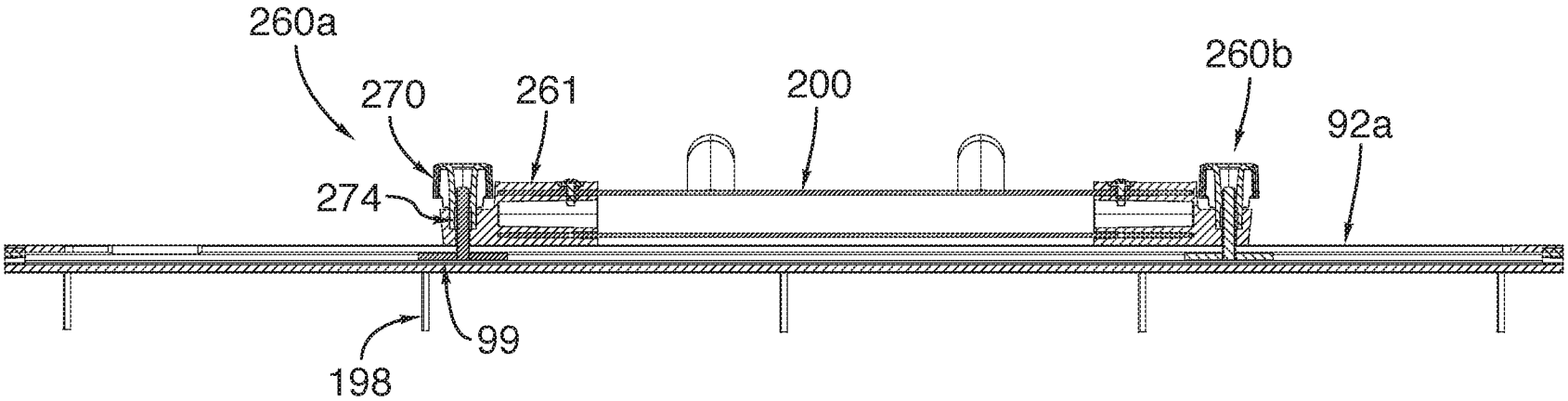
FIG. 14 is an elevation view of the cross-section of the rail shown in FIG. 12, taken along line XIV-XIV.

With further reference to FIGS. 13 and 14, defined between the top, bottom and side walls 93, 91, 95*a*, 95*b* of the central portion 94 is a channel 97 for slidably receiving therein sliding plates 99*a*-99*d* of the seat assembly 250. Together, the receiving opening 192, the elongated slot 190 and the channel 97 allow mounting the seat assembly 250 to the bottom wall 37 of the seating area 38 and permit free movement of the seat assembly 250 between the front and rear ends 194, 196 of the rail 92*a* when the user desires.

The rail 92*a* will now be further described with reference to FIG. 10. Given that lateral flange 96*a* is identical to lateral flange 96*b*, only lateral flange 96*a* will be described. Provided on the lateral flange 96*a* is a circular hole 197 located halfway between the front end and the rear end 194, 196, and four oblong holes 199*a*-199*d*. The circular hole 197 is configured for receiving therethrough threaded fastener 198*e*, for securing the rail 92*a* to the bottom wall of the seating area 38. More precisely, the mounting portions 90*a*, 90*b* of the seating area 38 are each provided with a plurality of holes for receiving therein the threaded fasteners 198*a*-198*e* and allowing the same to securely fasten the rails 92*a*, 92*b* to the mounting portions 90*a*, 90*b*, respectively. It is noted that although in this embodiment two rails 92*a*, 92*b* are mounted in the seating area 38 of the kayak 10, other configurations may be evident to the skilled addressee including one rail, more than two rails or rails mounted to the side walls of the kayak. The rail may additionally include graduations to keep the seat at predetermined locations along the rail.

Referring back to FIGS. 1 and 2, the recessed area 30 is provided with two raised portions 150, 152 extending from the junction of the battery compartment 36 to the rear end 34 of the recessed area 30. The two raised portions 150, 152 are relatively flat and textured to enhance adhesion between an anti-slip material (anti-slip mats 151, 153 shown in FIG. 1) applied to the raised portions 150, 152 (shown in FIG. 2). The anti-slip mats 151, 153 may be made of ethylene-vinyl acetate, though other materials may be evident to the skilled addressee. Additionally, the mats 151, 153 may be applied to the raised portions 150, 152 using an adhesive or using a mechanical fastener (e.g. rivets) or any other means as deemed suitable by the skilled addressee. Together with the side walls 33, 35 and back wall 39 of the recessed area 30, the rail mounting portions 90*a*, 90*b* and the abutment surface 50 of the battery compartment 36, the two raised portions 150, 152 define a number of channels 154*a*-154*c* leading to three drainage holes 156*a*-156*c* for draining water that may inadvertently enter the seating area 38. The drainage hole 156*a* may also alternatively be used for receiving therein a transducer (not shown), such as a sonar transducer. In addition to the drainage holes 156*a*-156*c*, the kayak 10 is provided with a t recessed contact point 158. The recessed contact point 158 provides somewhat of a vertical column from the hull 24 to the deck 20 of the kayak 10 contributing to the overall rigidity of the body 12.

There is additionally provided two footrests 170*a*, 170*b*, each one projecting inwardly from the side walls 33, 35 and positioned in the recessed area 30 proximal to the battery compartment 36, When the user is in the seated position on the seat assembly 250, he/she may use the footrests 170*a*, 170*b*. Together with the footrests 68*a*, 68*b* of the battery cover 60, the footrests 170*a*, 170*b* provide two options for the user to position his feet, for improved comfort.

Additionally, there are provided side storage straps 160. With reference to FIG. 9, each side storage strap 160 is comprised of an elastic belt 163, a tri-glide buckle 161, a V-shaped elastic band 167. The elastic belt 163 is held at a first end by the V shaped elastic band 167, which imparts tension to the elastic belt 163, and fastened to each of the side walls 33, 35 at a second end. In the illustrated embodiment, a semi cylinder-shaped storage receptacle 171 is provided between the side walls 33, 35 and the side storage straps 160. It is envisaged that a user may, for example, store a bottle or can of a drink inside the receptacle 171. The user may also use the area under the V-shaped elastic band 167 for storing a flat storage box (e.g. a toolbox or a fishing bait box), while the side storage strap 160 area proximal to the seat assembly 250 may be used for safety paddles. Other uses and variations thereof may be apparent to the skilled addressee.

Figure 12:
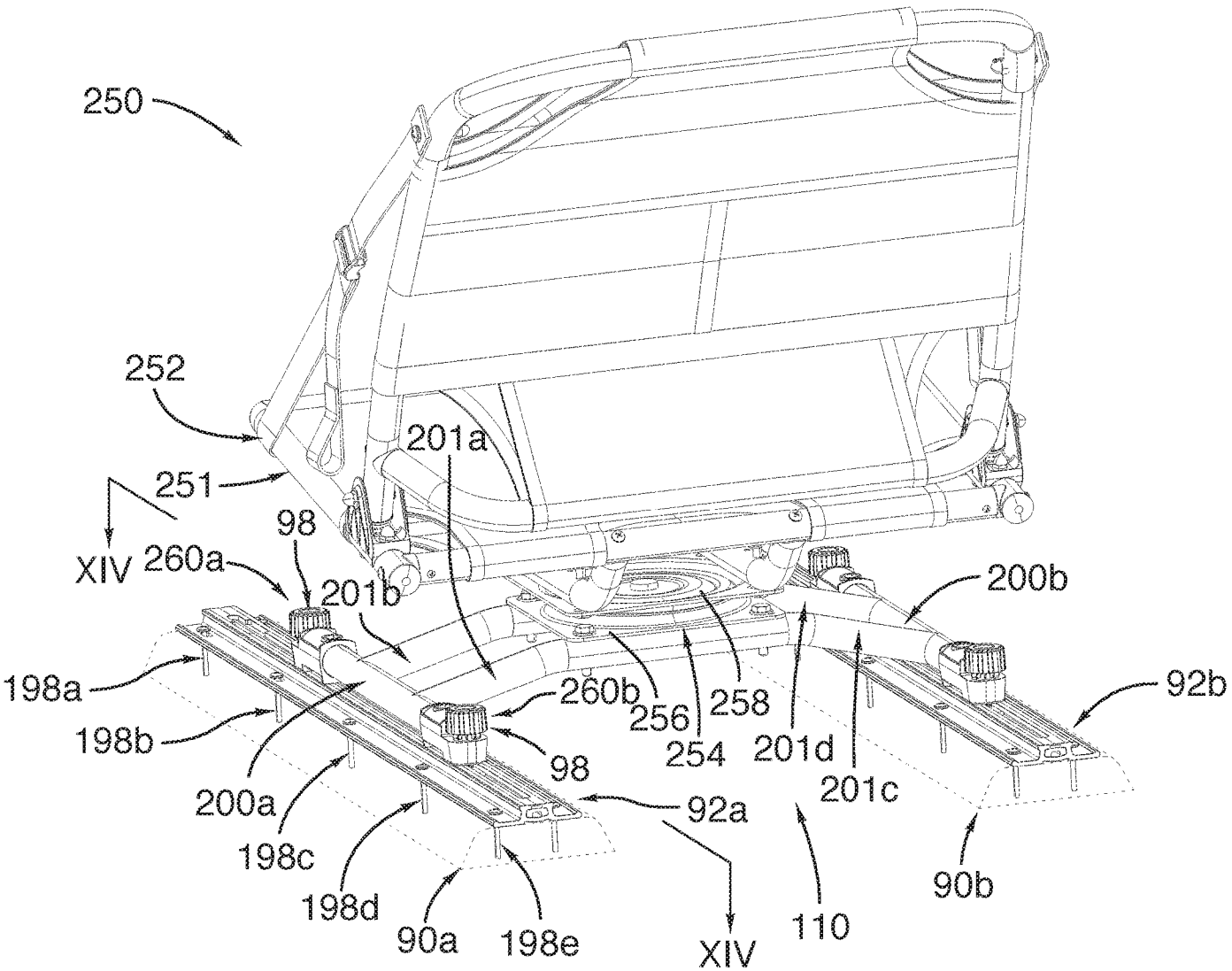
FIG. 12 is a top perspective view of a seat assembly for mounting onto the watercraft shown in FIG. 1, in accordance with one embodiment.

Turning now to FIG. 12, the seat assembly 250 will now be described. The seat assembly 250 comprises a lower frame assembly 110, a pivot assembly 254 mounted to the lower frame assembly 110 and a seat 252 mounted onto the pivot assembly 254. As it will become apparent below, the pivot assembly 254 allows the seat 252 to rotate relative to the lower frame assembly 110 about a generally vertical rotation axis R-R.

With reference to FIG. 13, the lower frame assembly 110 comprises a pair of spaced-apart, longitudinal members 200*a*, 200*b* as well as a pair of cross-members 201*a*-201*b* extending perpendicular to the longitudinal members 200*a*, 200*b* and connecting them to one another.

Each longitudinal member 200*a*, 200*b* is a tubular member made of aluminum and comprises a front end 209*a*, 209*b* and a rear end 207*a*, 207*b*, to which are mounted securing assemblies 260*a*-260*d* for engaging the rails 92*a*, 92*b*. The securing assemblies 260*a*-260*d* being identical, only securing assembly 260*a* will be described. It will nevertheless be appreciated that a similar description also applies to securing assemblies 260*b*-260*d*. Securing assembly 260*a* comprises a body 261 made of aluminum and comprising a tube receiving portion 262 comprising a cylindrical hole sized and shaped to receive therein one of the front or back ends 207*a*, 209*a* of the longitudinal member 200*a* and a lip 265 extending downwardly. The body 261 also comprises a projection 267 extending from the tube receiving portion and comprising a counterbored oblong hole 263, the oblong hole 263 being sized and shaped to receive therein a lower portion 272 of a knob 270 and a threaded rod 274 engaging the knob 270.

More specifically, in the illustrated embodiment, the threaded rod 274 comprises an upper end 276 received in the lower portion 272 of the knob 270 as well as a lower end 278 to which is fixedly attached the sliding plate 99*a*. The sliding plate 99*a* is sized and shaped to pass through the receiving opening 192 of the rail 92*a* to engage the sliding channel 97 while the threaded rod 274 is sized to extend through the elongated slot 190 and to move therein between the front end 194 and the rear end 196 of the rail 92*a*. As the width of the elongated slot 190 is smaller than the width of the receiving opening 192, when the sliding plate 99*a* attached to the lower end 278 of the threaded rod 274 is moved in the sliding channel 97, away from the receiving opening 192, the sliding plate 99*a* engages the top wall of the sliding channel 97. As such, when the knob 270 of the securing assembly 260 is fastened, it forces the threaded rod 274 and the sliding plate 99*a* attached thereto vertically, and the body 261 of the fastening assembly 260 downwardly against the rail 92*a*, to sandwich the top wall 93 of the rail 92*a* between the sliding plate 99 and the body 261 of the securing assembly 260, thereby increasing frictional engagement to prevent movement of the lower frame assembly 100 along the rails 92. Conversely, when the user wants to move the seat assembly 250 forward or backward in the rails 92, he/she unscrews the knob 270, thereby relieving frictional engagement between the body 261 and the sliding plate 99*a* of the securing assembly 260*a* and allowing easier movement of the seat assembly 250 relative to the rails.

As best shown in FIG. 12, the pivoting assembly 254 comprises a lower plate 256, and upper plate 258 and a bearing assembly therebetween (not shown), the bearing assembly allowing rotational movement of the lower 256 and upper plates 258 relative to one another. The lower plate 256 is generally square and comprises one mounting hole at each corner. Likewise, the upper plate 258 is square and comprises one mounting hole at each corner. To secure the pivoting assembly 254 to the lower frame assembly 110, a plurality of threaded fasteners are engaged in the mounting holes of the lower plate 256 and in corresponding holes defined in the cross-members and fastened therein. To fasten the upper plate 258 of the pivoting assembly 254, a plurality of threaded fasteners are engaged in the mounting holes and in corresponding mounting holes found in the in longitudinal members extending below the seat bottom portion 251 of the seat 252.

As it will be appreciated, the fact that the seat assembly 250 can pivot or swivel, in addition to sliding in a forward/backward direction, allows a user to move the seat assembly 250 so as to fish comfortably seated in a forward direction or in a backward direction. For instance, when the user wants to travel over relatively long distances using the motor or the paddles, he/she will position the seat assembly 250 in a forward looking position (i.e. corresponding to the position of the seat in a typical kayak), and slide the seat assembly 250 toward the rear end of the kayak 10, thereby providing sufficient room for his/her legs in front on the seat assembly 250 (i.e. between the seat 252 and the battery compartment 36), while sitting. Alternatively, the flat portions 150, 152 provided with anti-slip mats 151, 153 allow the user to stand up in the kayak 10 to cast a net or fish on either side or toward the front end (or bow 14) of the kayak 10 (or any direction spanning 360 degrees). Conversely, if the user want to fish in a seated position facing the rear (or stern 16) of the kayak 10, he/she pivots the seat by 180 degrees and slides the seat assembly 250 toward the front (or bow 14) of the kayak 10, thereby providing leg room between the seat assembly 250 and the rear end 34 of the recessed area 30. As the raised flat portions 150, 152 provided with anti-slip mats 151, 153 extend proximal to the rear end 34 of the recessed area 30, the user can also safely stand up to cast a net or fish on either side of the kayak 10, as well as face a rearward direction. An additional benefit of the sliding seat assembly 250 is that it allows for improved mass distribution in the kayak 10. Coupled with the battery compartment 36 being installed on the bow end 14 of the kayak 10 and the motor and motor mount 210 installed on the stern end 16 (opposite to the bow end 14), the kayak 10 provides better mass distribution overall, resulting in improved stability. It will be understood that such features may not necessarily be found in conventional (i.e., recreational/non-fishing) kayaks, or that such features may be configured differently without departing from the scope of this embodiment.

As has been mentioned previously, the width W of the kayak 10 is greater than some existing models in order to increase stability of the kayak 10. In one embodiment the width W of the body 12 ranges from 20 inches to 60 inches, more preferably between 30 inches to 40 inches, and more preferably the width W is 38 inches. The greater width W of the kayak 10 may render the use of paddles more difficult in some instances. To alleviate the potential drawbacks of having a wider kayak 10, the side walls 33, 35 each comprise a chamfered surface 13*a*, 13*b* in a central section of the kayak 10 in order to allow a better angle for paddles held by a user to engage the water upon which the kayak 10 is floating. In one embodiment, the length L of the body 12 ranges between 80 and 140 inches, preferably between 110 inches and 130 inches, and is more preferably about 10 feet. The length of 10 feet was specifically chosen to simplify transport of the kayak, wherein the kayak can be transported on a pickup truck and without a need to be towed. As it will be appreciated by the skilled addressee, the kayak 10 could have a different width W and a different length L than those provided without departing from the scope of the embodiment.

As it can be appreciated, the configuration of the recessed area 30, as well as the location of the battery compartment 36 and the possibility of moving the seat 252 in the seating area 38 provides more possibilities for the user to position his/her legs, either in a seating or standing position. Further, the battery compartment 36 being placed proximal to the bow end 14 of the kayak 10, it contributes to balance the weight of the battery 40 against the weight of a motor mounted to the stern end 16.

The low weight and compact dimensions of the kayak 10 allow a single user to displace said kayak with ease. The kayak 10 will fit on the bed of many pickup trucks (with the tailgate down) for transport to a body of water. Alternatively, the kayak 10 may be carried on top of a car. Once at the site, a single user may displace the kayak 10 by pulling it using the front handle 15. Additionally, the kayak 10 also has two side handles 17*a*, 17*b* on each of the side walls 33, 35, the side handles 17*a*, 17*b* having tracks therein to allow a camera, a transducer or another item to be mounted by the user onto the tracks.

Figure 15:
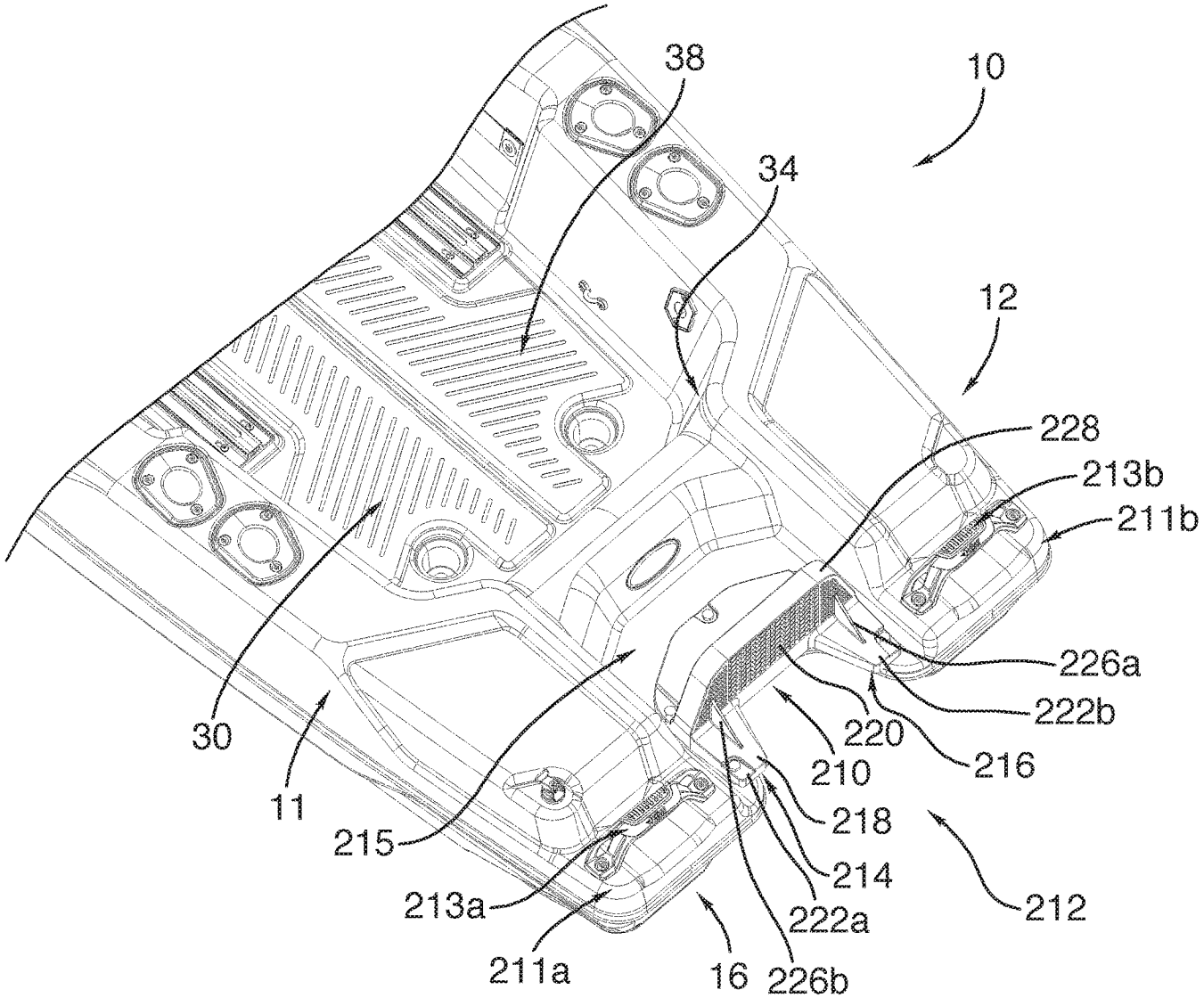
FIG. 15 is a top perspective view of a stern end of the watercraft shown in FIG. 1.
Figure 16:
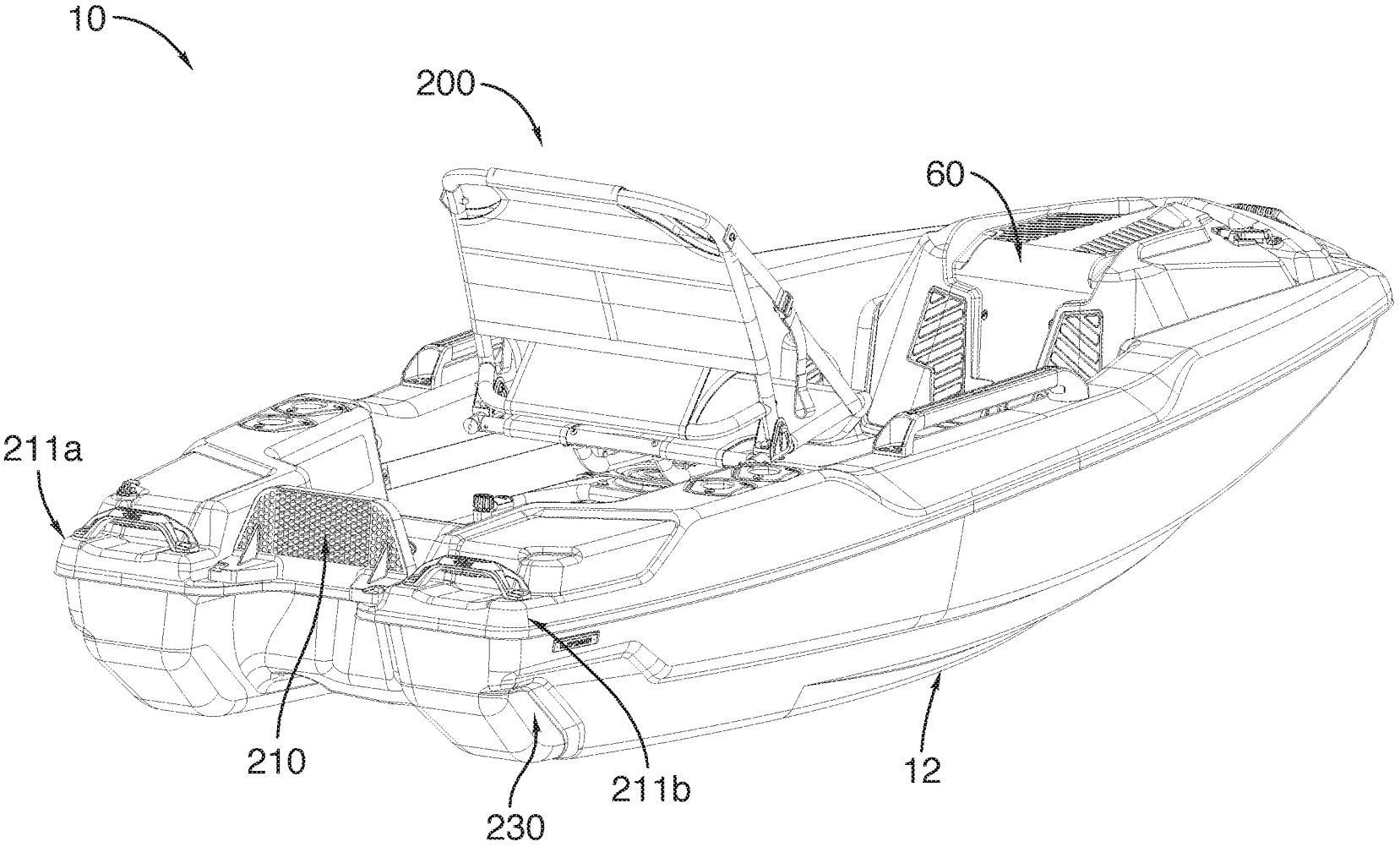
FIG. 16 is a top-rear perspective view of the watercraft shown in FIG. 1.
Figure 17:
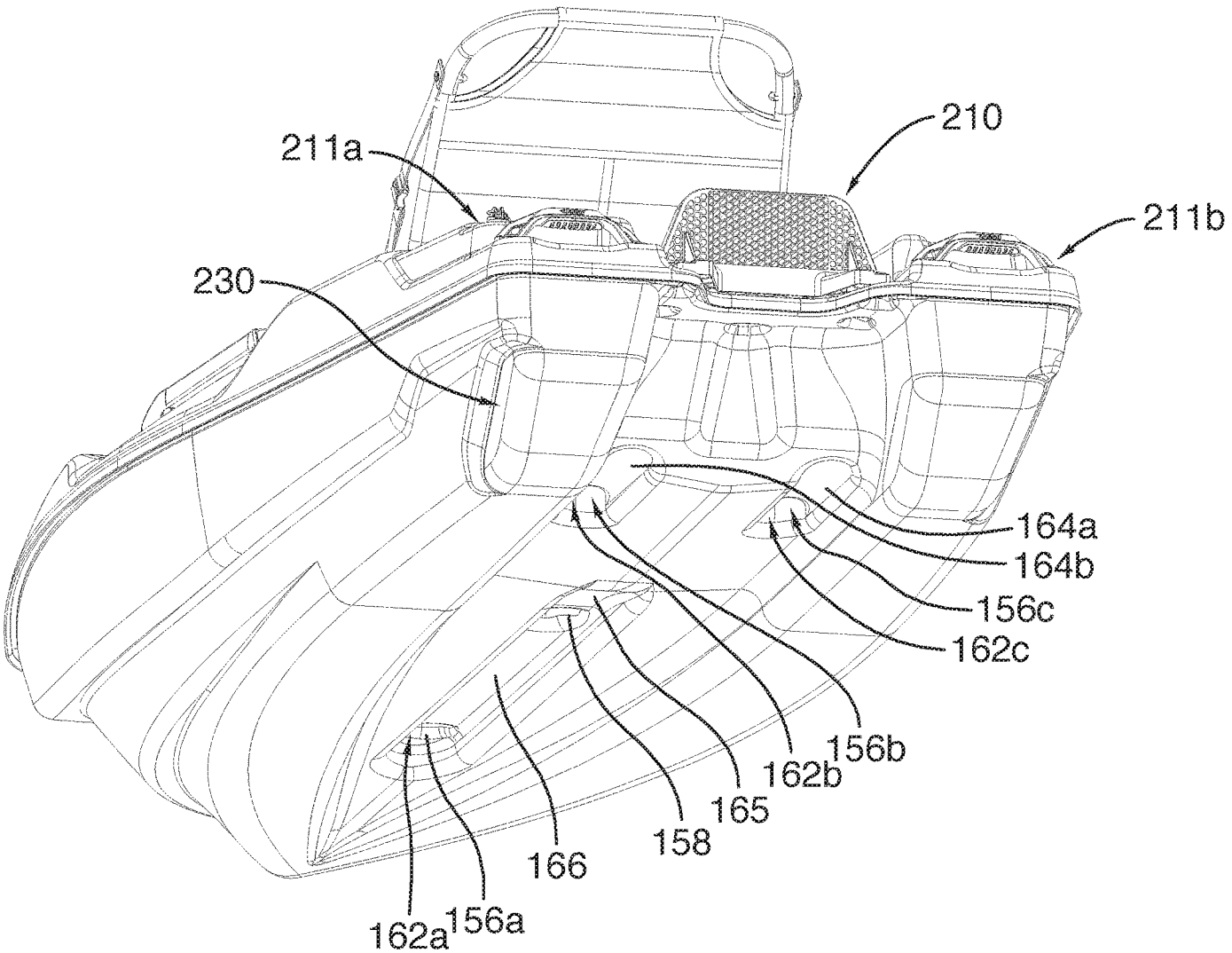
FIG. 17 is a bottom perspective view of the watercraft shown in FIG. 1.
Figure 18:
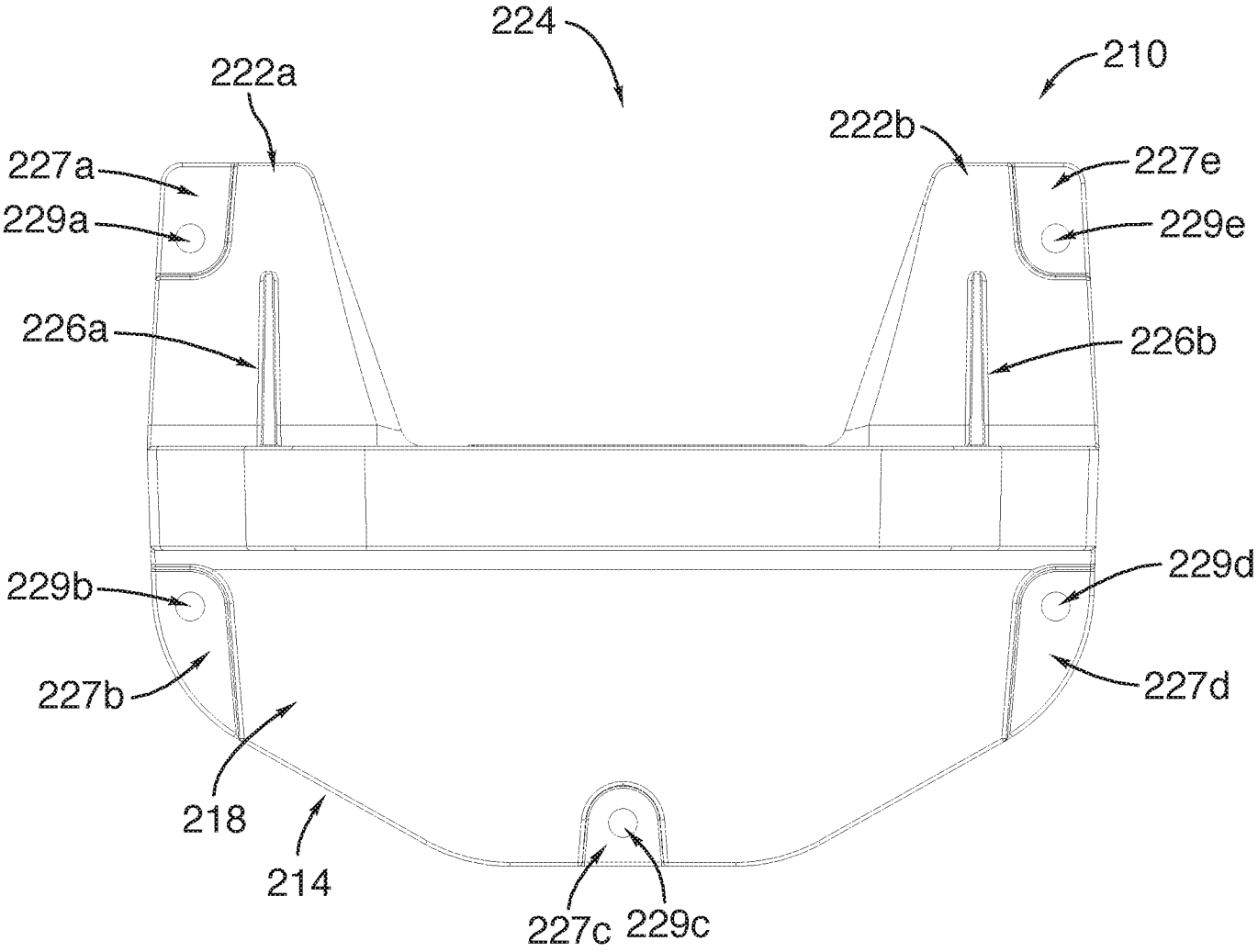
FIG. 18 is a top plan view of a motor mount, in accordance with one embodiment.
Figure 19:
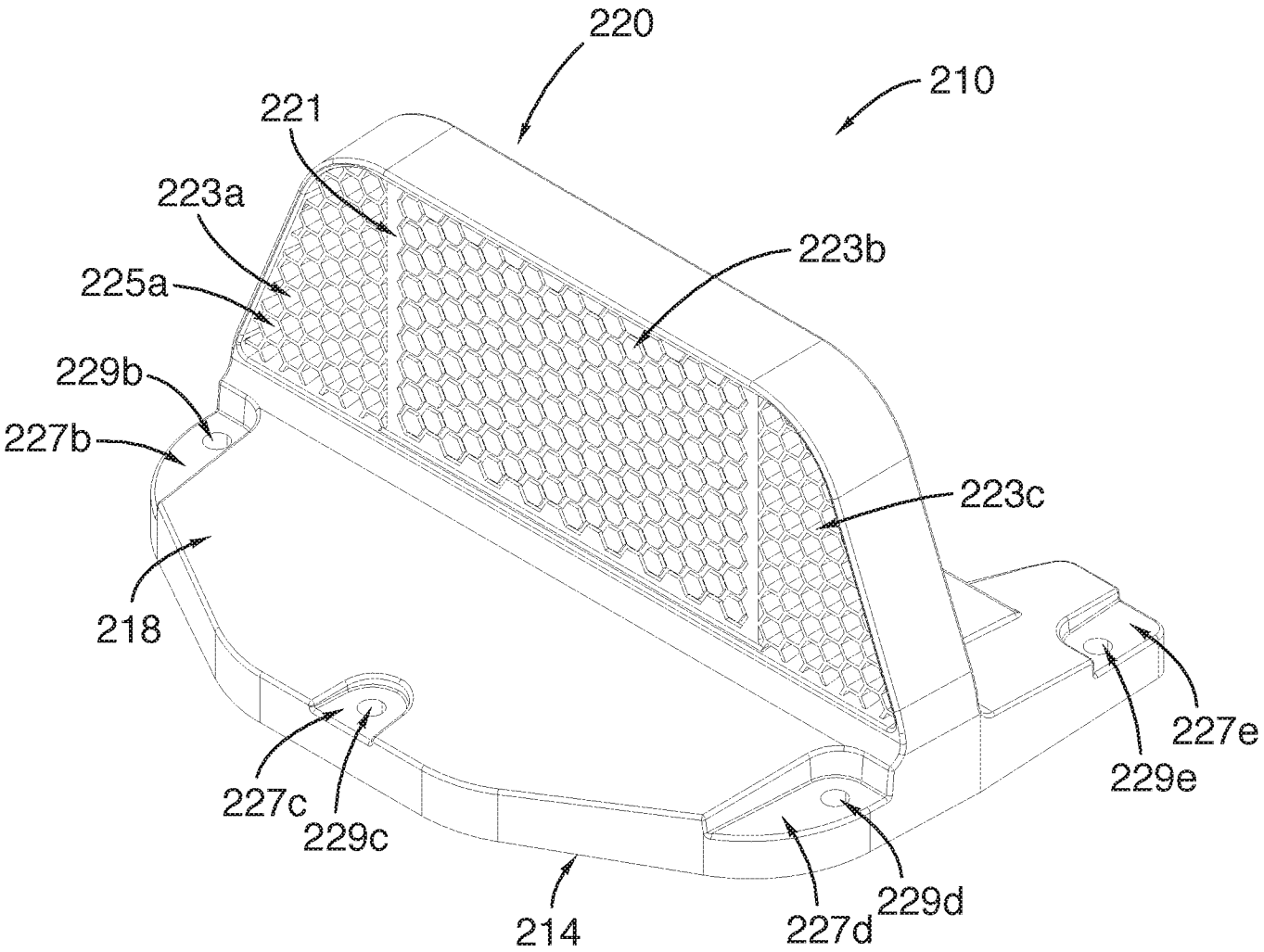
FIG. 19 is a top perspective view of the motor mount shown in FIG. 18.
Figure 20:
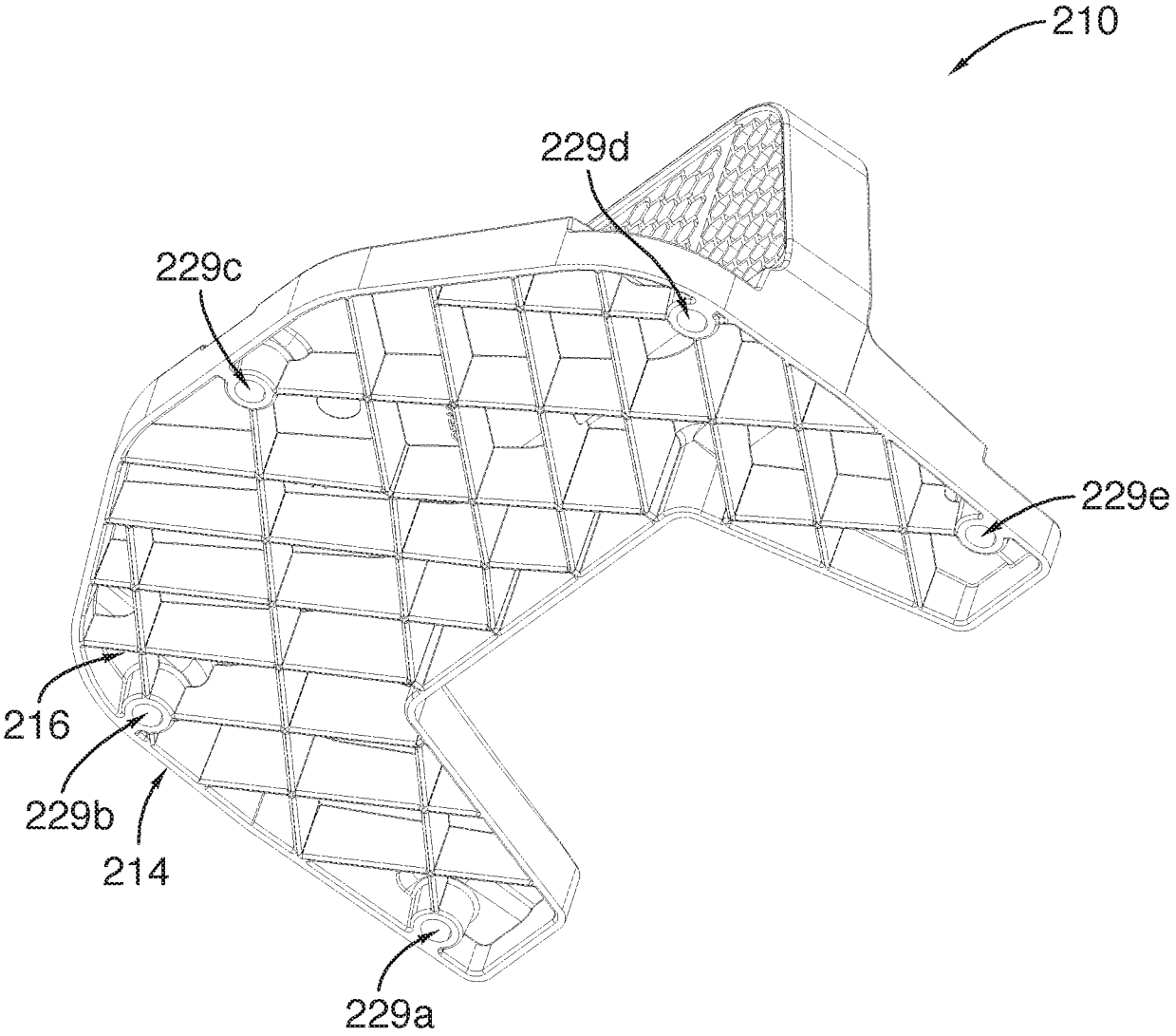
FIG. 20 is a bottom perspective view of the motor mount shown in FIG. 18.
Figure 21:
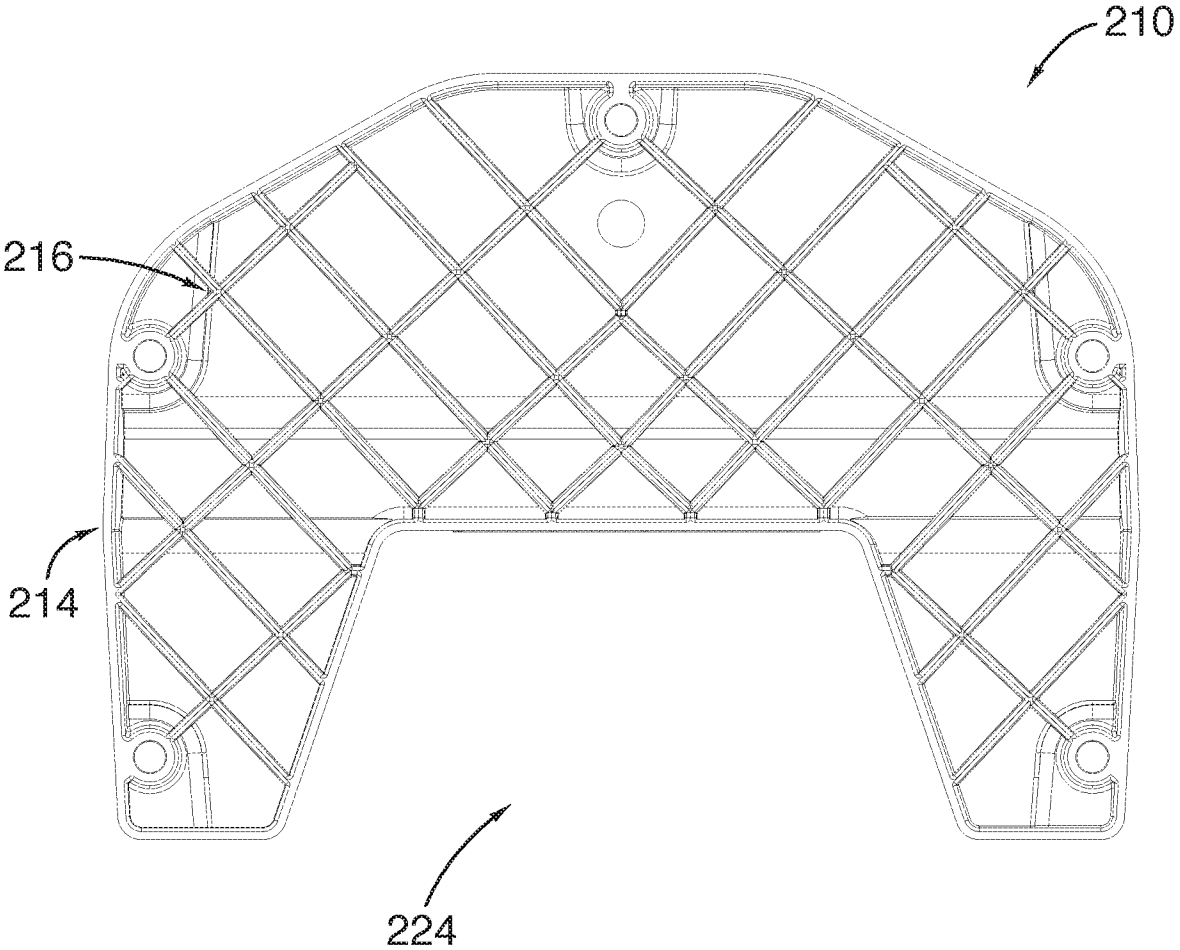
FIG. 21 is a bottom plan view of the motor mount shown in FIG. 18.
Figure 22:
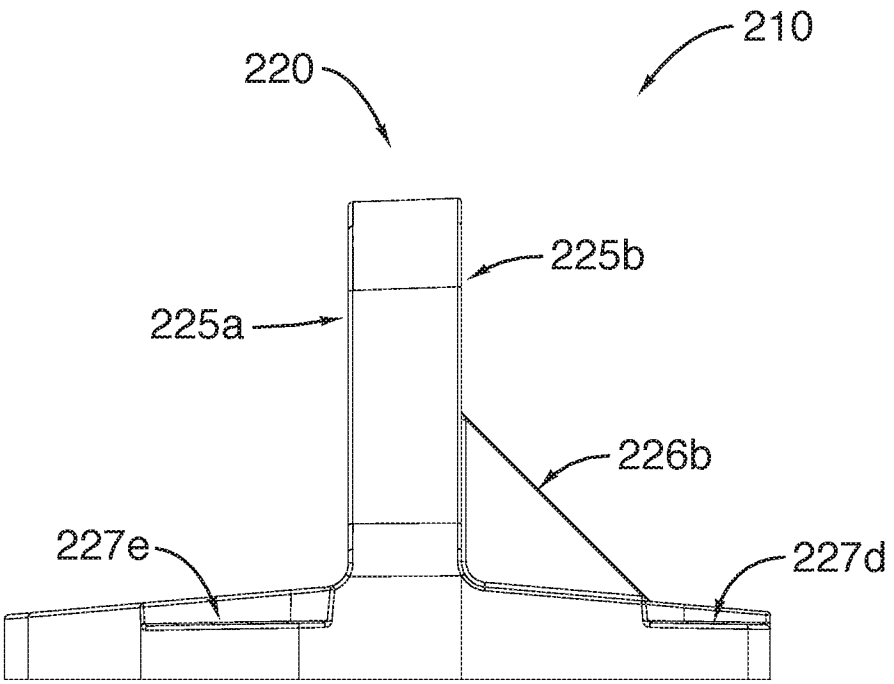
FIG. 22 is a side elevation view of the motor mount shown in FIG. 18.

With reference to FIGS. 15 to 17, the rear (stern) end 16 of the kayak 10 will now be described. In the illustrated embodiment, the stern end 16 of the kayak 10 is configured for receiving a conventional outboard electric or gasoline motor (not shown), via a motor mount 210. More specifically, the deck 20 of the body 12 comprises a rear cavity 212 having a generally flat surface, defined between a pair of spaced-apart side bumps 211*a*, 211*b* and proximal to the rear of the motor mount 210 for receiving a motor therein. The bumps 211*a*, 211*b* extend outwardly from the stern end 16 of the kayak 10 and each include a rear handle 213*a*, 213*b* allowing a user to handle the kayak 10 from the stern end 16 as. A motor mount surface 213 additionally extends between the cavity 212 and the rear wall 39, providing a surface for the motor mount 210 to be installed onto. The motor mount installation surface 215 is coplanar with the top surface of the bumps 211*a*, 211*b*, though other configurations may be evident. Additionally, the motor mount surface 215 is vertically positioned so as to ensure that the propellers of the motor (not shown) mounted to the motor mount 210 are sufficiently submerged in the water during use.

With reference to FIGS. 15 to 22, the motor mount 210 comprises a generally C-shaped horizontal base 214 having a lower side 216 (adjacent to the deck of the kayak when mounted thereto) and an upper side 218. The C-shaped horizontal base 214 comprises a main portion 220 from which extends rearwardly a pair of spaced-apart projections 222*a*, 222*b*. Defined between the spaced-apart projections 222*a*, 222*b* is a space 224 sized for accommodating the midsection of an electric or gasoline outboard motor. Extending upwardly and generally vertically from the upper side 222*a*, 222*b* of the base 214 is a clamping portion 221 for receiving thereon a conventional mounting or clamping bracket or a quick tilt device of an electric or gasoline outboard motor (not shown). To further reinforce the motor mount 210, a pair of gussets 226*a*, 226*b* extend between the clamping portion 220 and the projections 222*a*, 222*b*. Five recesses 227*a*-227*d* in which are defined five corresponding holes 229*a*-229*d* are provided on the C-shaped base 214, the recesses 227*a*-227*d* and holes 229*a*-229*d* being positioned to be in alignment with corresponding holes in the motor mount installation surface 215 at the stern end 16 of the kayak 10, for mounting the motor mount 210 to the body 12 using five threaded fasteners. It is envisaged that other devices (e.g. an electric motor, an anchorage system) could also be fastened to the kayak 10 through the holes in the motor mount surface. The C-shape of the motor mount 210 is shaped such that the edges of the motor mount 210 coincide with the rear cavity 212 of the kayak 10, such that the rear cavity 212 is also C-shaped. In the illustrated embodiment, the motor mount 210 is mounted to the kayak 10 instead of being formed integrally with the kayak 10 and is made of more rigid material. In some instances, this may be advantageous to deal with significant torsional forces applied by a motor/propeller assembly mounted thereto during operation. In the illustrated embodiment, the motor mount 210 is therefore formed of a harder or more rigid material than the kayak 10 and mounted thereto using a plurality of fasteners 226. Alternatively, it is envisaged that other devices (e.g. anchorage devices) could be fastened to the kayak 10 instead of the motor mount 210.

The motor mount 210 allows the use of conventional clamps so that any motor can be clamped thereto. That is to say that the motor mount 210 is not specific to any model of motor, allowing the user greater choice in selecting a motor. Additionally, the clamping portion 221 has a lip 228 which prevents the motor from being accidentally released from the kayak 10 as a result of the clamp slipping against the clamping portion 221. In one embodiment, the clamping portion 221 of the motor mount 210 is a honeycomb structure. The honeycomb structure consists of two side sections 223*a*, 223*c* and a middle section 223*b*. The honeycomb cells extend from a first surface 225*a* of the main portion 220 to a second surface 225*b*. The cells are not void all the way through. The side sections 223*a*, 223*c* of the main portion 220 have a solid surface extending proximate the second surface 225*b*, while the middle section 223*b* has a solid surface extending proximate the first surface 225*a*. The addition of the solid surfaces provides additional rigidity to the honeycomb structure. In one embodiment, the motor mount is made using a plastic injection molding process, though other means such as 3D printing may also be evident to the skilled addressee. The honeycomb structure also contributes to provide an improved gripping surface for the motor clamps to grip to.

As previously described, two cable holes 42, 43 in the body 12 of the kayak 10 allow electrical connection between the battery compartment 36 and a motor on the motor mount 210. Cables are wired in the body 12 of the kayak 10 during manufacture so as to provide an electrical connection between the battery and motor. Providing the wires results in a "plug and play" setup for the user of the kayak 10, meaning they need only to connect the connecting ends of the prewired cables to the motor and battery to provide an electrical connection therebetween. In order to prevent water ingress into the body 12 of the kayak 10 through the holes 42, 43, a sealant is provided around the holes 42, 43. In one embodiment, this may be a rubber gasket and/or caulking, though other solutions may be evident to the skilled addressee.

With reference to FIG. 17, the hull 24 of the kayak will now be described in some further detail. The drains 156 all have drainage passages 162*a*-162*c* leading to the hull 24 of the kayak 10. The hull 24 of the kayak 10 has recesses 164*a*, 164*b*, 166 defining a path leading from the exit of the drainage passages 162*a*-162*c* along the longitudinal axis $L_1$-$L_1$ of the kayak 10. The recesses 164*a*, 164*b*, 166 are shaped at an angle (relative to a plane of the seating area 38), such that water exits the recesses 164*a*, 164*b*, 166 while providing minimal resistance against the kayak 10 during forward movement of the kayak 10. The recess 166 further comprises a 'ramp' portion 165 which presents a smooth transition so as to minimize water resistance (relative to a straight angle). The longitudinal shape of the recesses 164*a*, 164*b*, 166 and the fact that they are recessed with respect to the hull 24, therefore combine to allow water to exit the kayak 10 with less resistance on the body 12 of the kayak 10 relative to a kayak with only straight angles in its hull for drainage of water. This is due to the water exiting the deck 20 with pathways which minimize contact (and therefore resistance) with the kayak 10.

Figure 23:
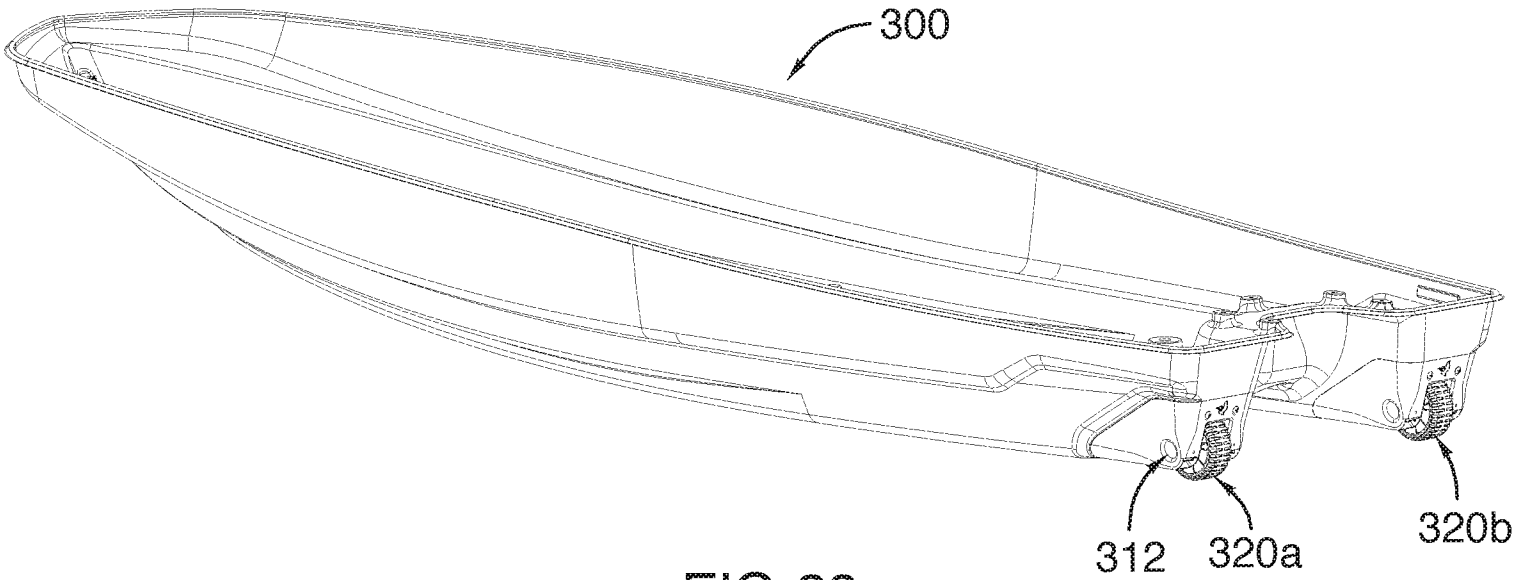
FIG. 23 is a top perspective view of an alternative embodiment of a hull, in accordance with one embodiment.
Figure 24:
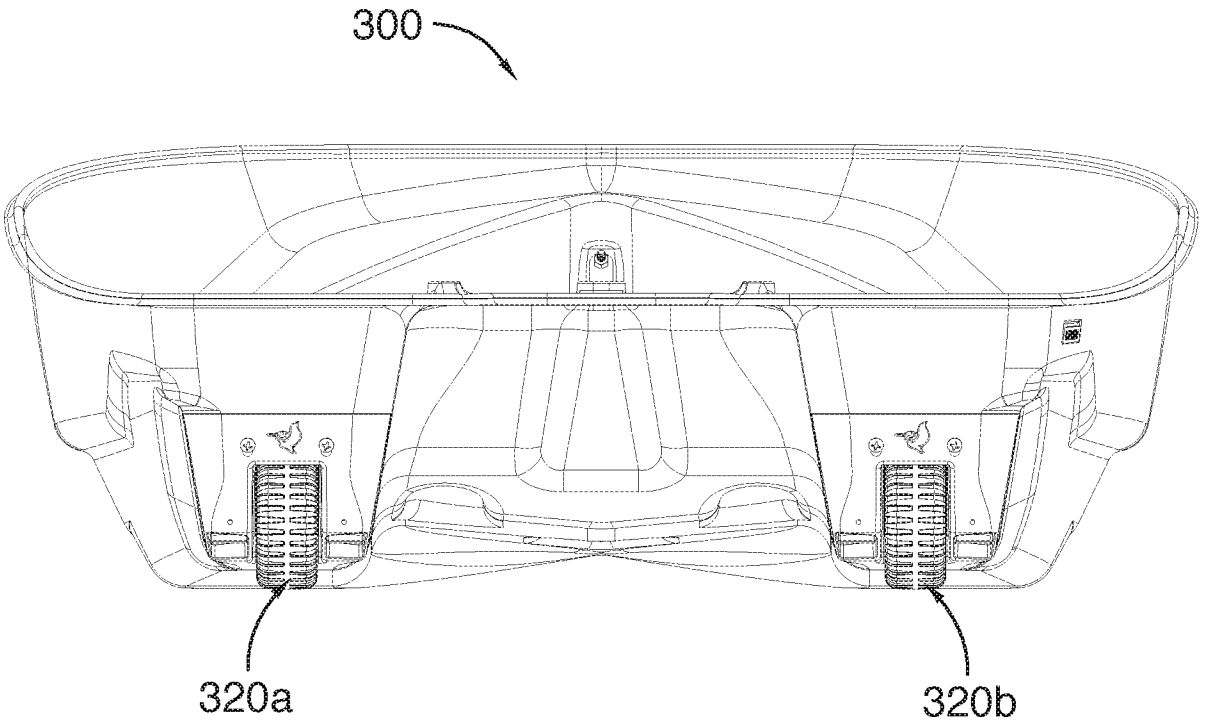
FIG. 24 is a rear elevation view of the hull shown in FIG. 23.
Figure 25:
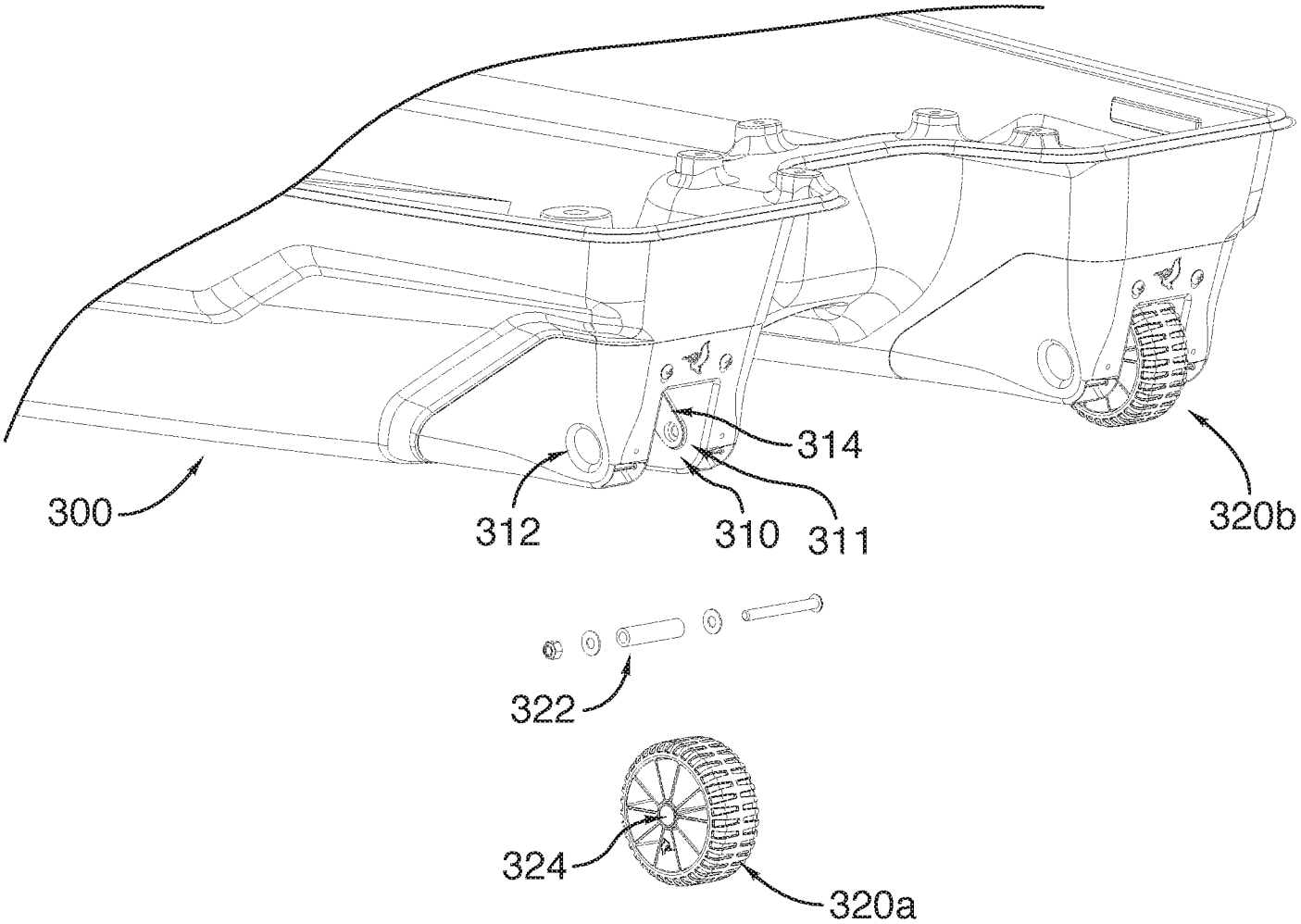
FIG. 25 is a partially exploded view of the hull shown in FIG. 23.

With reference to FIGS. 23 to 25, in an alternative embodiment the kayak 10 has a a hull 300 that is substantially similar to hull 24, but is configured to make transport of the kayak 10 simpler, by providing a pair of wheels 320*a*, 320*b* at the rear (stern) end 16 of the kayak 10. The wheels 320*a*, 320*b* allow the user to simply drag the kayak 10 on the ground using a front handle 15. In one embodiment, the wheels 320*a*, 320*b* are removably attached to rear side sections 302*a*, 302*b*. This allows a user to decide whether to keep or remove wheels 320*a*, 320*b* as required. A method of installation of the wheels 320*a*, 320*b* will now be described with particular reference to wheel 320*a*. Given that the two wheels are installed in an identical fashion, further description of wheel 320*b* will not be required. In one embodiment, the wheel 320*a* is fastened onto the hull 300 by first placing it inside a recessed area 310. A fastening shaft 322 is then inserted into a central aperture 324 of the wheel 320*a* through side apertures 312 of the side section 302*a*. The wheel 320*a* is kept out of contact from side walls 311 of the recessed area 310 by a raised portion 314 which sits against the hub of the wheel 320. The raised portion extends along the surface of the side walls 311 of the recessed area 310 to the aperture 312 of the rear side section 302. In one embodiment, the fastening shaft 322 is a bolt and is fastened in place using a nut. It may be coupled with a bearing to allow the wheel to spin in place. Other configurations for mounting a wheel to a kayak may be evident to the skilled addressee. Other means of installing a wheel onto a kayak or other forms of improving the mobility of a kayak may be evident to the skilled addressee.

As it will be appreciated, one of the advantages of having a kayak with a motor is that it allows a single user to either manually paddle the boat or use power from the motor as desired. This is possible due to the relatively low weight of a kayak as opposed to a heavier water-faring vehicle, as well as the smaller physical dimensions of the kayak 10.

While the kayak 10 has been described in connection with the embodiments illustrated in FIGS. 1 to 25, it will be understood that variations are possible without departing from the scope of the invention. For instance, while the motor mount 210 and the seat assembly 250 are described in connection with a kayak 10 provided with a single seat 252, they could also be used in connection with a tandem kayak, or with any other type of watercraft, including small boats, paddleboards or pedal boats. As it will be appreciated, the kayak 10 and its components can be made of plastic materials using known manufacturing methods including thermoforming, rotomolding, plastic injection and/or a combination thereof. Further, the kayak 10 could be made of any other type of suitable material.

The embodiments described above are intended to be exemplary only. The scope of the invention is therefore intended to be limited solely by the appended claims.

The invention claimed is:

1. A watercraft comprising:

a body extending along a longitudinal axis $L_1$ comprising
- a deck and a hull, the deck comprising:
- a seating area, the seating area comprising:
  - two rails extending parallel to the longitudinal axis $L_1$, each rail being independently coupled to a surface of the watercraft;
  - a swivel seat assembly comprising:
  - two longitudinal members each slidably mounted on a respective rail of the two rails, and
- a securing assembly coupled to at least one of the two longitudinal members and configured to be manually moved between an unlocked position, where the swivel seat assembly is configured to be manually operated to slide along the two rails, and a locked position where the swivel seat assembly is locked to at least one of the two rails.

2. The watercraft of claim 1, wherein the watercraft further comprises a motor mount mounted on the deck and outside the seating area, the motor mount being adapted for mounting a motor thereon.

3. The watercraft of claim 2, wherein the motor mount comprises a base for mounting the motor mount to the deck of the watercraft and a mounting portion extending generally vertically from the base.

4. The watercraft of claim 3, wherein the mounting portion of the motor mount comprises a lip for preventing slipping of the motor against the motor mount.

5. The watercraft of claim 4, wherein the watercraft further comprises a battery compartment.

6. The watercraft of claim 5, wherein the motor mount and battery compartment are electrically connectable through wiring provided inside the body of the watercraft.

7. The watercraft of claim 6, wherein the battery compartment has a securably removable battery cover to prevent ingress of liquid into the battery compartment.

8. The watercraft of claim 6, wherein the battery compartment is mounted at a first end of the watercraft and the motor mount is mounted at a second end of the watercraft, opposite the first end.

9. The watercraft of claim 6, wherein the first end of the watercraft is the bow end and the second end of the watercraft is the stern end.

10. The watercraft of claim 1, wherein the watercraft is a fishing watercraft.

11. The watercraft of claim 10, wherein the fishing watercraft is a fishing kayak.

12. The watercraft of claim 1, wherein the watercraft comprises at least one wheel mounted to the body.

13. The watercraft of claim 12, wherein the watercraft comprises a recessed slot in the hull adapted to mounting a transducer therein.

14. A watercraft comprising:

a body extending along a longitudinal axis $L_1$, comprising a deck and a hull, the deck comprising a recessed area and including two side walls, wherein the recessed area includes:

a seating area, the seating area comprising:

two rails extending parallel to the longitudinal axis $L_1$, each rail being independently coupled to a surface of the watercraft;

a swivel seat assembly comprising:

two longitudinal members each slidably mounted on a respective rail of the two rails, and a securing assembly coupled to at least one of the two longitudinal members and configured to be manually moved between an unlocked position, where the swivel seat assembly is configured to be manually operated to slide along the two rails, and a locked position where the swivel seat assembly is locked to at least one of the two rail.

15. A watercraft comprising:

a body extending along a longitudinal axis $L_1$, comprising a deck and a hull, the deck comprising a recessed area and including two side walls, wherein the recessed area includes:

a seating area, the seating area comprising:

at least one rail extending parallel to the longitudinal axis $L_1$; and a swivel seat assembly, the swivel seat assembly being removably mounted on the at least one rail, the swivel seat assembly being securably affixed to the at least one rail to allow sliding movement of the swivel seat assembly along the at least one rail, wherein the watercraft has at least one side wall handle mounted to at least one of the two side walls, the at least one side wall handle having tracks therein.

16. The watercraft of claim 14, wherein the watercraft has at least one handle mounted to a front end of the watercraft.

17. The watercraft of claim 14, wherein the watercraft additionally includes a motor mount mounted on a stern end of the watercraft and outside the recessed area for mounting a motor thereon.

18. The watercraft of claim 17, wherein the motor mount comprises a base for mounting the motor mount to the deck of the watercraft and a mounting portion extending generally vertically from the base.

19. The watercraft of claim 18, wherein the motor mount has a lip for preventing slipping of the motor against the motor mount.

20. The watercraft of claim 18, wherein the watercraft includes a battery compartment.

21. The watercraft of claim 20, wherein the motor mount and battery compartment are electrically connectable through wiring provided inside the body of the watercraft.

22. The watercraft of claim 21, wherein the battery compartment is mounted at a bow end of the watercraft and the motor mount is mounted at a stern end of the watercraft.

23. The watercraft of claim 1, wherein the watercraft is configured to be manually paddled.

24. The watercraft of claim 1, wherein the watercraft further comprises a pedal configured to propel the watercraft.

25. The watercraft of claim 1, wherein the two longitudinal members are tubular members, and the swivel seat assembly further comprises a first pair of cross-members connected to the two longitudinal members.

26. The watercraft of claim 25, wherein the swivel seat assembly further comprises a second pair of cross-members connected to the two longitudinal members.

27. The watercraft of claim 1, wherein each of the two rails has a channel that faces upwards.

28. The watercraft of claim 1, wherein an end of one or more of the two longitudinal members is received by a tube receiving portion of the securing assembly.

29. The watercraft of claim 28, further comprising two or more securing assemblies.

* * * * *